US006184851B1

(12) United States Patent
Yamaguchi et al.

(10) Patent No.: US 6,184,851 B1
(45) **Date of Patent: *Feb. 6, 2001**

(54) IMAGE FORMING APPARATUS AND METHOD OF MANUFACTURING AND ADJUSTING THE SAME

(75) Inventors: Eiji Yamaguchi, Zama; Hidetoshi Suzuki, Fujisawa, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/724,312

(22) Filed: Oct. 1, 1996

(30) Foreign Application Priority Data

Oct. 3, 1995 (JP) ..... 7-256052
Sep. 25, 1996 (JP) ..... 8-253016

(51) Int. Cl.[7] ..... G09G 3/22

(52) U.S. Cl. ..... 345/75.2; 345/74.1; 345/150; 445/24

(58) Field of Search ..... 345/75, 76–78, 345/103, 94, 100; 313/495, 496, 497; 445/24; 348/655, 744; 315/169.1, 169.2

(56) References Cited

U.S. PATENT DOCUMENTS

| | | | | |
|---|---|---|---|---|
| 5,066,883 | | 11/1991 | Yoshioka et al. | 313/309 |
| 5,426,447 | * | 6/1995 | Lee | 345/103 |
| 5,654,607 | * | 8/1997 | Yamaguchi et al. | 313/495 |
| 5,686,936 | * | 11/1997 | Maekawa et al. | 345/100 |
| 5,708,454 | * | 1/1998 | Kaoth | 345/100 |

FOREIGN PATENT DOCUMENTS

| | | | |
|---|---|---|---|
| 0619595 | 10/1994 | (EP) | H01J/31/12 |
| 0661726 | 7/1995 | (EP) | H01J/31/12 |
| 1-031332 | 2/1989 | (JP) . | |
| 2-257551 | 10/1990 | (JP) . | |
| 4-249827 | 9/1992 | (JP) . | |
| 8-96700 | 4/1996 | (JP) . | |
| 8-212943 | 8/1996 | (JP) | H01J/31/12 |

OTHER PUBLICATIONS

Advances in Electronics and Electron Physics, vol. 8, pp. 89–185, 1956, W. P. Dyke et al., "Field Emission".

Journal of Applied Physics, vol. 47, No. 12, Dec. 1976, pp. 5248–5263, C.A. Spindt et al., "Physical properties of thin–film field emission cathodes with molybdenum cones".

Journal of Applies Physics, vol. 32, Jan.–Dec. 1961, pp. 646–652, C. A. Mead, "Operation of Tunnel–Emission Devices".

(List continued on next page.)

*Primary Examiner*—Xiao Wu
*Assistant Examiner*—Francis Nguyen
(74) *Attorney, Agent, or Firm*—Fitzpatrick, Cella, Harper & Scinto

(57) ABSTRACT

It is an object of the invention to provide an image forming apparatus capable of easily obtaining a white balance and performing image display with excellent color reproduction properties, and a method of manufacturing and adjusting the image forming apparatus. A plurality of surface conduction electron-emitting devices (1002) are arranged on a substrate (1001). Light emission is performed in accordance with the colors (R, G, and B) of phosphors applied to a phosphor film (1008) upon electron emission from the devices, so that an image is formed. The electron-emitting characteristics of the surface conduction electron-emitting devices (1002) are shifted in advance in correspondence with corresponding phosphor colors. Therefore, a satisfactory white balance of light emission of the R, G, and B phosphors can be obtained.

20 Claims, 24 Drawing Sheets

OTHER PUBLICATIONS

Radio Engineering and Electronic Physics, vol. 10, Jul. 1965, pp. 1290–1296, M. L. Elinson et al., "The Emission of Hot Electrons and the field Emission of Electrons From Tin Oxide".

Thin Solid Films, 9(1972) pp. 317–328, G. Dittmer, "Electrical Conduction and Electron Emission of Discontinuous Thin Films".

IEDM/IEEE Trans. Ed. Conf., pp. 519–521, 1975, M. Hartwell et al., "Strong Electron Emission From Patterened Tin–indium Oxide thin Films".

Journal Of The Vacuum Society of Japan, vol. 26, No. 1, pp. 22–29, 1983, H. Araki et al., "Electroforming and Electron Emission of Carbon Thin Films".

* cited by examiner

IMAGE FORMING APPARATUS AND METHOD OF MANUFACTURING AND ADJUSTING THE SAME

BACKGROUND OF THE INVENTION

1. Field of the Invention

The present invention relates to an image forming apparatus and a method of manufacturing and adjusting the same and, more particularly, to an image forming apparatus using a multi-electron-beam source in which a plurality of surface conduction electron-emitting devices are arranged, and a method of manufacturing and adjusting the same.

2. Related Background Art

Conventionally, two types of devices, namely hot and cold cathode devices, are known as electron-emitting devices. Examples of cold cathode devices are field emission type emission devices (to be referred to as FE type devices hereinafter), metal/insulator/metal type emission devices (to be referred to as MIM type devices hereinafter), and surface conduction electron-emitting devices.

Known examples of the FE type devices are described in W. P. Dyke and W. W. Dolan, "Field emission", Advance in Electron Physics, 8,89 (1956) and C. A. Spindt, "Physical properties of thin-film field emission cathodes with molybdenum cones", J. Appl. Phys., 47,5248 (1976).

A known example of the MIM type devices is described in C. A. Mead, "Operation of Tunnel-emission Devices", J. Appl. Phys., 32,646 (1961).

A known example of the surface conduction electron-emitting devices is described in, e.g., M. I. Elinson, Radio. Eng. Electron Phys., 10 (1965) and other examples to be described later.

The surface conduction electron-emitting device utilizes the phenomenon that electron emission is caused in a small-area thin film, formed on a substrate, by passing a current parallel to the film surface. The surface conduction electron-emitting device includes devices using an Au thin film (G. Dittmer, "Thin Solid Films", 9,317 (1972)), an $In_2O_3/SnO_2$ thin film (M. Hartwell and C. G. Fonstad, "IEEE Trans. ED Conf.", 519 (1975)), and a carbon thin film (Hisashi Araki, et al., "Vacuum", Vol. 26, No. 1, p. 22 (1983)), and the like, in addition to an $SnO_2$ thin film according to Elinson mentioned above.

FIG. 24 is a plan view of the surface conduction electron-emitting device according to M. Hartwell et al. as a typical example of the structures of these surface conduction electron-emitting devices. Referring to FIG. 24, reference numeral 3001 denotes a substrate, and 3004 a conductive thin film made of a metal oxide formed by sputtering. This conductive thin film 3004 has an H-shaped pattern, as shown in FIG. 24. An electron-emitting portion 3005 is formed by performing an electrification process (referred to as an energization forming process to be described later) with respect to the conductive thin film 3004. Referring to FIG. 24, a spacing L is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion 3005.

In the above surface conduction electron-emitting device by M. Hartwell et al., typically the electron-emitting portion 3005 is formed by performing the electrification process called the energization forming process for the conductive thin film 3004 before electron emission. According to the energization forming process, electrification is performed by applying a constant DC voltage which increases at a very slow rate of, e.g., 1 V/min, to both ends of the conductive thin film 3004, so as to partially destroy or deform the conductive thin film 3004 or by changing the properties of the conductive thin film 3004, thereby forming the electron-emitting portion 3005 with an electrically high resistance. Note that the destroyed or deformed part of the conductive thin film 3004 or the part where the properties are changed has a fissure. Upon application of an appropriate voltage to the conductive thin film 3004 after the energization forming process, electron emission is performed near the fissure.

The above surface conduction electron-emitting devices are advantageous because they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied.

Regarding applications of surface conduction electron-emitting devices to, e.g., image forming apparatuses such as an image display apparatus and an image recording apparatus, charged beam sources and the like have been studied.

As an application to image display apparatuses, in particular, as disclosed in U.S. Pat. No. 5,066,883 and Japanese Patent Laid-Open No. 2-257551 filed by the present applicant, an image display apparatus using the combination of a surface conduction electron-emitting device and a phosphor which emits light upon irradiation of an electron beam has been studied. This type of image display apparatus is expected to have better characteristics than other conventional image display apparatuses. For example, in comparison with recent popular liquid crystal display apparatuses, the above display apparatus is superior in that it does not require a backlight since it is of a light emissive type and that it has a wide view angle.

The present inventors have examined surface conduction electron-emitting devices according to various materials, manufacturing methods, and structures, in addition to the above conventional devices. The present inventors have also studied a multi-electron-beam source in which a lot of surface conduction electron-emitting devices are arranged and an image display apparatus to which this multi-electron source is applied.

The present inventors have also examined a multi-electron-beam source according to an electric wiring method shown in FIG. 25. More specifically, this multi-electron source is constituted by two-dimensionally arranging a large number of surface conduction electron-emitting devices and wiring these devices in a matrix, as shown in FIG. 25.

Referring to FIG. 25, reference numeral 4001 denotes a surface conduction electron-emitting device, 4002 a row wiring layer, and 4003 a column wiring layer. The row wiring layers 4002 and the column wiring layers 4003 actually have limited electrical resistances which are represented as wiring resistances 4004 and 4005 in FIG. 25. The wiring shown in FIG. 25 is referred to as simple matrix wiring.

For illustrative convenience, the multi-electron source constituted by a 6×6 matrix is shown in FIG. 25. However, the scale of the matrix is not limited to this arrangement, as a matter of course. In case of a multi-electron-beam source for an image display apparatus, a number of devices sufficient to perform desired image display are arranged and wired.

In the multi-electron source in which the surface conduction electron-emitting devices are wired in a simple matrix, as shown in FIG. 25, appropriate electrical signals are supplied to the row wiring layers 4002 and the column wiring layers 4003 to output desired electron beams. When the surface conduction electron-emitting devices of an arbitrary row of the matrix are to be driven, a selection voltage Vs is applied to the row wiring layer 4002 of the selected row. Simultaneously, a non-selection voltage Vns is applied to the row wiring layers 4002 of unselected rows. In synchronism with this operation, a driving voltage Ve for outputting electron beams is applied to the column wiring layers 4003. According to this method, a voltage (Ve−Vs) is applied to the surface conduction electron-emitting devices of the selected row, and a voltage (Ve−Vns) is applied to the surface conduction electron-emitting devices of the unselected rows, assuming that a voltage drop caused by the wiring resistances 4004 and 4005 is negligible. When the voltages Ve, Vs, and Vns are set to appropriate levels, electron beams with a desired intensity are output from only the surface conduction electron-emitting devices of the selected row. When different driving voltages Ve are applied to the respective column wiring layers, electron beams with different intensities are output from the respective surface conduction electron-emitting devices of the selected rows. Since the response of the surface conduction electron-emitting device is very quick, the period of time over which electron beams are output can also be changed in accordance with the period of time for applying the driving voltage Ve.

The multi-electron source having surface conduction electron-emitting devices arranged in a simple matrix can be used in a variety of applications. For example, the multi-electron source can be suitably used for an image display apparatus by appropriately supplying an electrical signal according to image information.

However, the multi-electron source in which the surface conduction electron-emitting devices are arranged in the simple matrix has the following problem in fact.

As described above, when an image display apparatus is constituted by combining surface conduction electron-emitting devices and phosphors which emit light upon irradiation of electron beams, phosphors of three primary colors, i.e., red (R), green (G), and blue (B) are normally used.

However, since the R, G, and B phosphors exhibit different light emission characteristics, as will be described later, no satisfactory white balance can be obtained when electron beams having the same intensity are incident on the phosphors of the respective colors.

FIG. 26A is a graph showing typical light emission characteristics of the phosphors of the respective colors. As shown in FIG. 26A, the characteristic curve of a phosphor changes depending on the color of emitted light and has non-linearity. The light emission characteristic of a phosphor is defined depending on the total amount of charges reaching a unit-area phosphor surface per unit time. The degree of non-linearity also changes depending on the type of the phosphor.

The non-linearity of the characteristic curve of the phosphor can be corrected to an almost linear characteristic by inserting, for each color, a gamma correction circuit which is conventionally used for a CRT or the like. FIG. 26B is a graph showing the characteristics of the respective color phosphors after gamma correction. The gradient changes depending on the colors. When the difference between the gradients according to the colors does not correspond to the ratio of incident electron beam intensities for the respective colors, which ratio defines a satisfactory white balance, the color reproduction properties are degraded.

SUMMARY OF THE INVENTION

The present invention has been made to solve the above-described problems and has as its object to provide an image forming apparatus capable of easily obtaining a white balance and performing image display with excellent color reproduction properties, and a method of manufacturing and adjusting the image forming apparatus.

In order to achieve the above object, an image forming apparatus of the present invention has the following arrangement.

The image forming apparatus comprises a multi-electron-beam source having a plurality of surface conduction electron-emitting devices arranged on a substrate, light emission means for emitting light upon irradiation of an electron beam from the multi-electron source, and modulating means for modulating the electron beam being irradiated on the light emission means on the basis of an input image signal, wherein, for each of the surface conduction electron-emitting devices, an electron-emitting characteristic is shifted in advance in accordance with a light emission characteristic of the light emission means by applying a voltage having a value larger than a maximum value of a driving voltage.

Preferably, the surface conduction electron-emitting devices are arranged in a vacuum vessel in which a partial pressure of an organic gas is not more than $1\times10^{-8}$ Torr.

Preferably, the light emission means comprises phosphors.

Preferably, the phosphors have three primary colors of red, green, and blue, and the electron-emitting characteristic of each of the surface conduction electron-emitting device is shifted such that a white balance of the three primary colors is maintained.

Preferably, in the multi-electron source, the plurality of surface conduction electron-emitting devices are two-dimensionally arranged and wired in a matrix by row wiring layers and column wiring layers substantially perpendicular to the row wiring layers.

Preferably, in the multi-electron source, the plurality of surface conduction electron-emitting devices are arranged in a row direction, and grid electrodes are arranged in a column direction substantially perpendicular to the row direction.

The present invention also incorporates a method of manufacturing an image forming apparatus. The present invention provides a method of manufacturing an image forming apparatus having a multi-electron-beam source having a plurality of surface conduction electron-emitting devices arranged on a substrate, light emission means for emitting light upon irradiation of an electron beam from the multi-electron source, and driving means for applying a driving voltage to the multi-electron source on the basis of an input image signal, comprising the step of applying a characteristic shift voltage having a value larger than a maximum value of the driving voltage applied by the driving means to the surface conduction electron-emitting devices in advance, such that electron-emitting characteristics of the surface conduction electron-emitting devices are shifted in accordance with a light emission characteristic of the light emission means. Preferably, the characteristic shift voltage is applied in a vacuum atmosphere in which a partial pressure of an organic gas is not more than $10^{-8}$ Torr.

Preferably, the light emission means comprises phosphors. Preferably, the phosphors have three primary colors of red, green and blue, and the electron-emitting characteristic of each of the surface conduction electron-emitting devices is shifted such that a white balance of the three primary colors is maintained. Preferably, in the multi-electron source, the plurality of surface conduction electron-emitting devices are wired in a matrix by a plurality of column wiring layers and a plurality of row wiring layers.

The present invention also incorporates a method of adjusting an image forming apparatus, in which the electron-emitting characteristics of surface conduction electron-emitting devices are shifted to adjust the white balance if the white balance has changed with the elapse of time after completion of the image forming apparatus. The present invention provides a method of adjusting an image forming apparatus having a multi-electron-beam source having a plurality of surface conduction electron-emitting devices arranged on a substrate, light emission means for emitting light upon irradiation of an electron beam from the multi-electron source, and driving means for applying a driving voltage to the multi-electron source on the basis of an input image signal, comprising the step of applying a characteristic shift voltage having a value larger than a maximum value of the driving voltage applied by the driving means to the surface conduction electron-emitting devices in advance such that electron-emitting characteristics of the surface conduction electron-emitting devices are shifted in accordance with a light emission characteristic of the light emission means. Preferably, the characteristic shift voltage is applied in a vacuum atmosphere in which a partial pressure of an organic gas is not more than $10^{-8}$ Torr. Preferably, the light emission means comprises phosphors. Preferably, the phosphors have three primary colors of red, green and blue, and the electron-emitting characteristic of each of the surface conduction electron-emitting devices is shifted such that a white balance of the three primary colors is maintained. Preferably, in the multi-electron source, the plurality of surface conduction electron-emitting devices are wired in a matrix by a plurality of column wiring layers and a plurality of row wiring layers.

According to the present invention, an appropriate electron-emitting characteristic is stored in advance in the surface conduction electron-emitting device in correspondence with the phosphor color. With this arrangement, an image forming apparatus capable of easily obtaining the white balance can be provided. When this image forming apparatus is applied, high-quality image display with a satisfactory color balance can be performed without using any complex correction circuit.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

An embodiment of the present invention will be described below in detail with reference to the accompanying drawings.

<First Embodiment>

In this embodiment, a display panel for performing image display will be described as an example of an image forming apparatus using surface conduction electron-emitting devices.

<<Arrangement and Manufacturing Method of Display Panel>>

Figure 1:
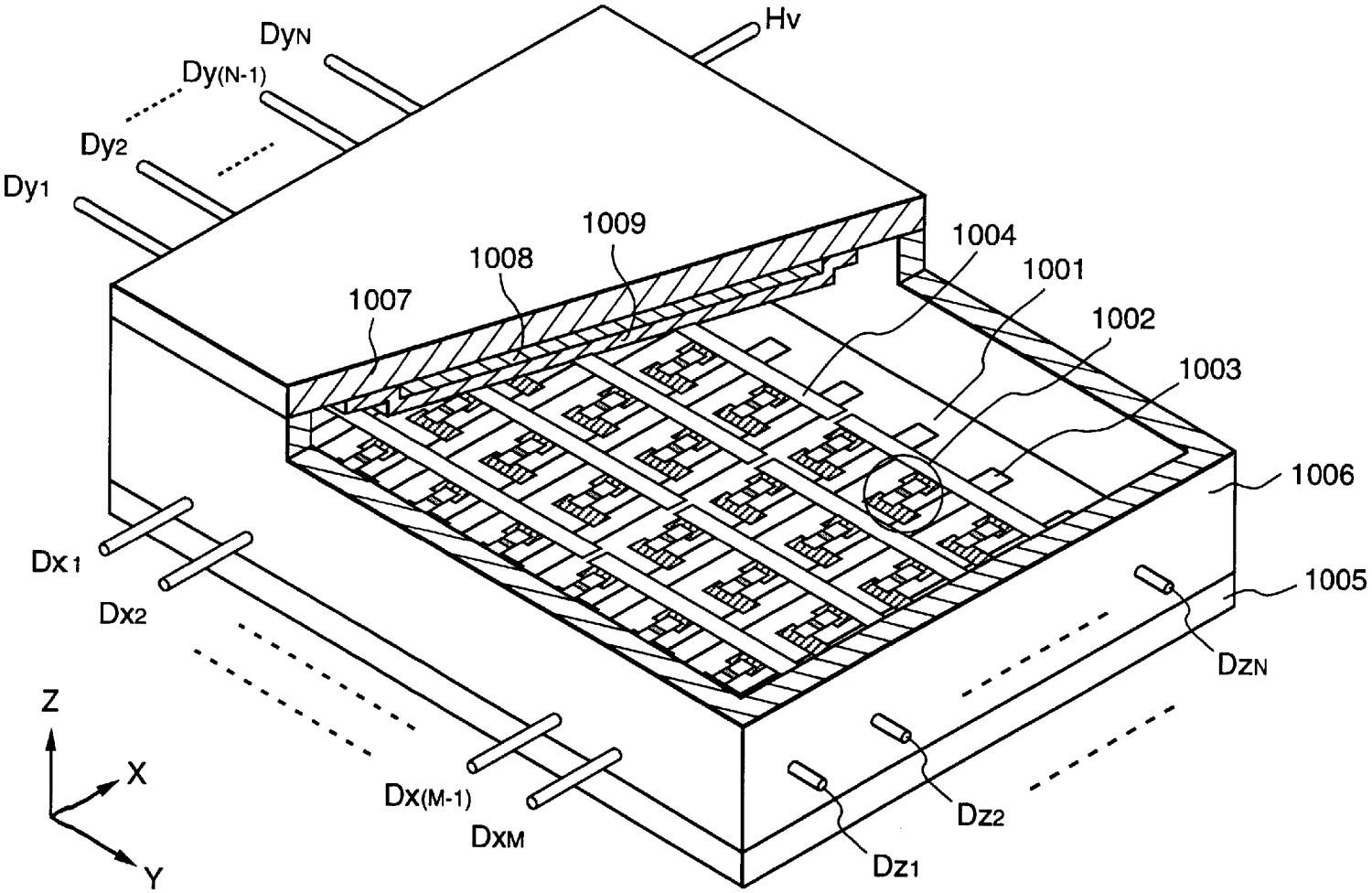
FIG. 1 is a partially cutaway perspective view of a display panel to which the first embodiment of the present invention is applied.

FIG. 1 is a partially cutaway perspective view of a display panel to which the first embodiment is applied, showing the internal structure of the panel.

Referring to FIG. 1, reference numeral 1005 denotes a rear plate, 1006 a side wall and 1007 a face plate. These parts form an airtight vessel for maintaining a vacuum in the display panel. To construct the airtight vessel, it is necessary to seal-connect the respective parts to allow their junction portions to hold a sufficient strength and airtight condition. For example, a frit glass is applied to the junction portions and baked at 400° C. to 500° C. in air or a nitrogen atmosphere for 10 minutes or more, thereby seal-connecting the parts. A method of evacuating the airtight vessel will be described later.

The rear plate 1005 has a substrate 1001 fixed thereon, on which N×M surface conduction electron-emitting devices 1002 are formed. M and N are positive integers of 2 or more and appropriately set in accordance with a target number of display pixels. For example, in a display apparatus for high-definition television display, preferably N=3,000 or more, and M=1,000 or more. In this embodiment, N=3,071, and M=1,024. The N×M surface conduction electron-emitting devices are arranged in a simple matrix with M row wiring layers and N column wiring layers 1004. The portion constituted by the substrate 1001, the surface conduction electron-emitting devices 1002, the row wiring layers 1003, and the column wiring layers 1004 will be referred to as a multi-electron-beam source. The manufacturing method and structure of the multi-electron source will be described later in detail.

In this embodiment, the substrate 1001 of the multi-electron source is fixed to the rear plate 1005 of the airtight vessel. However, if the substrate 1001 of the multi-electron source has sufficient strength, the substrate 1001 itself of the multi-electron source may be used as the rear plate of the airtight vessel.

Figure 2A:
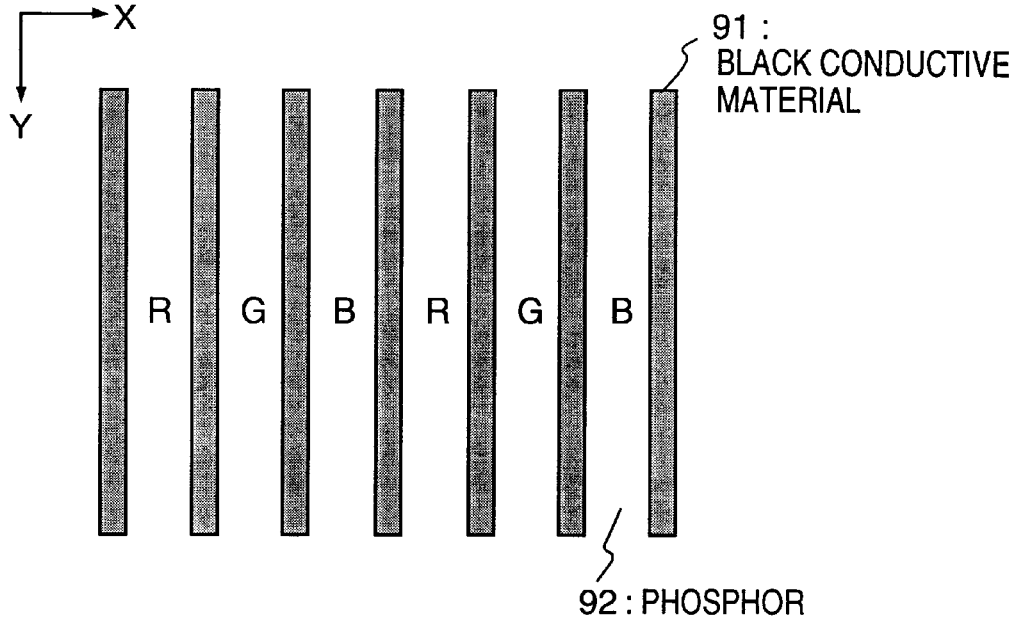
FIGS. 2A and 2B are views showing examples of arranging the phosphors of three primary colors.

Furthermore, a phosphor film 1008 is formed on the lower surface of the face plate 1007. As this embodiment is a color display panel, the phosphor film 1008 is coated with red (R), green (G), and blue (B) phosphors, i.e., three primary color phosphors used in the general CRT field. As shown in FIG. 2A, color phosphors 92 are applied in a striped arrangement. A black conductive material 91 is provided between the stripes of the phosphors. The purpose of providing the black conductive material 91 is to prevent display color misregistration even if the electron beam irradiation position is shifted to some extent, to prevent degradation of display contrast by shutting off reflection of external light, to prevent charge-up of the phosphor film 1008 by electron beams, and the like. The black conductive material 91 of this embodiment mainly consists of graphite, though any other material may be used as long as the above purpose can be attained.

Figure 2B:
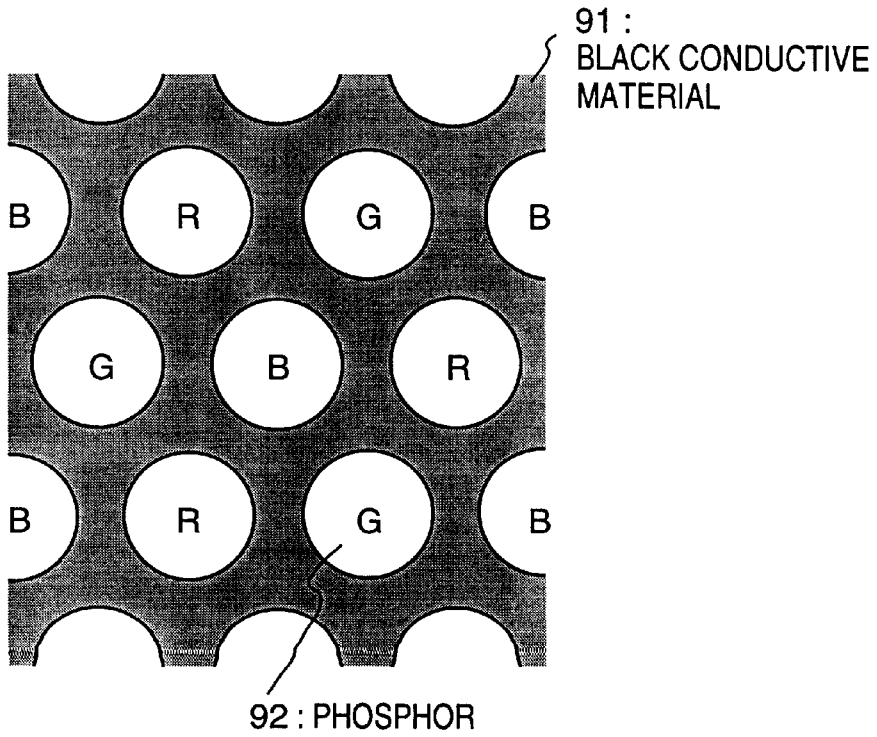

The arrangement of the phosphors of the three primary colors is not limited to the striped arrangement shown in FIG. 2A. For example, a delta arrangement as shown in FIG. 2B or other arrangements may be employed.

For a color display, a slurry method is used to apply the phosphors 92. However, even when a printing method is used for a color display, a similar coating film can be obtained, as a matter of course.

Furthermore, a metal back 1009, which is well-known in the general CRT field, is provided on the rear plate 1005 side surface of the phosphor film 1008. The purpose of providing the metal back 1009 is to improve the light-utilization ratio by mirror-reflecting part of light emitted from the phosphor film 1008, to protect the phosphor film 1008 from collision with negative ions, to use the metal back 1009 as an electrode for applying an electron beam accelerating voltage of, e.g., 10 kV, to use the metal back 1009 as a conductive path of electrons which excited the phosphor film 1008, and the like. The metal back 1009 is formed by forming the phosphor film 1008 on the face plate 1007, applying a smoothing process (normally called filming) to the phosphor film surface, and depositing aluminum (Al) thereon by vacuum deposition. Note that when a phosphor material for a low voltage is used for the phosphor film 1008, the metal back 1009 is not used.

Furthermore, for application of an accelerating voltage or improvement of the conductivity of the phosphor film, transparent electrons made of, e.g., ITO may be provided between the face plate 1007 and the phosphor film 1008.

Referring to FIG. 1, reference symbols Dx1 to DxM, Dy1 to DyN, Dz1 to DzN, and Hv denote electric connection terminals for an airtight structure provided to electrically connect the display panel to an electric circuit (not shown). The terminals Dx1 to DxM are electrically connected to the row wiring layers 1003 of the multi-electron source; the terminals Dy1 to DyN, to the column wiring layers 1004 of the multi-electron source; the terminals Dz1 to DzN, to the column wiring layers 1004 of another group; and the terminal Hv, to the metal back 1009 of the face plate.

To evacuate the airtight vessel, after forming the airtight vessel, an exhaust pipe and a vacuum pump (neither are shown) using no oil are connected, and the airtight vessel is evacuated to a vacuum of about $10^{-7}$ Torr. While keeping evacuation, the display panel is heated to 80° C. to 200° C. and baked for 5 or more hours to reduce the partial pressure of an organic gas. Thereafter, the exhaust pipe is sealed. To maintain the vacuum in the airtight vessel, a getter film (not shown) is formed at a predetermined position in the airtight container immediately before/after the sealing. The getter film is a film formed by heating and evaporating a gettering material mainly consisting of, e.g., Ba, by heating or RF heating. The suction effect of the getter film maintains a vacuum of $1\times10^{-5}$ to $1\times10^{-7}$ Torr in the airtight vessel. In this case, the partial pressure of the organic gas mainly consisting of carbon and hydrogen and having a mass number of 13 to 200 is set to be smaller than $10^{-8}$ Torr.

The basic arrangement and manufacturing method of the display panel according to this embodiment have been described above. A method of manufacturing the multi-electron source used in the display panel above will be described next.

For the multi-electron source used in the image display apparatus of this embodiment, any material or shape of the surface conduction electron-emitting device may be employed so long as it is for a multi-electron-beam source having surface conduction electron-emitting devices arranged in a simple matrix. However, the present inventors have found that among the surface conduction electron-emitting devices, one having an electron-emitting portion or its peripheral portion consisting of a fine particle film is excellent in electron-emitting characteristic and can be easily manufactured. Accordingly, such a surface conduction electron-emitting device is the most appropriate surface conduction electron-emitting device to be employed in a multi-electron-beam source of a high-brightness, large-screen image display apparatus. In the display panel of this embodiment, the surface conduction electron-emitting devices each having an electron-emitting portion or its peripheral portion made of a fine particle film are used. First, the basic structure, manufacturing method, and characteristic of the preferred surface conduction electron-emitting device will be described, and the structure of the multi-electron source having many devices wired in a simple matrix will be described later.

<<Preferred Structure and Manufacturing Method of Surface conduction electron-emitting device>>

The typical structure of the surface conduction electron-emitting device having an electron-emitting portion or its peripheral portion made of a fine particle film includes a plane type structure and a step type structure.

<<Plane Type Surface conduction electron-emitting device>>

The structure and manufacturing method of a plane type surface conduction electron-emitting device will be described first.

Figure 3A:
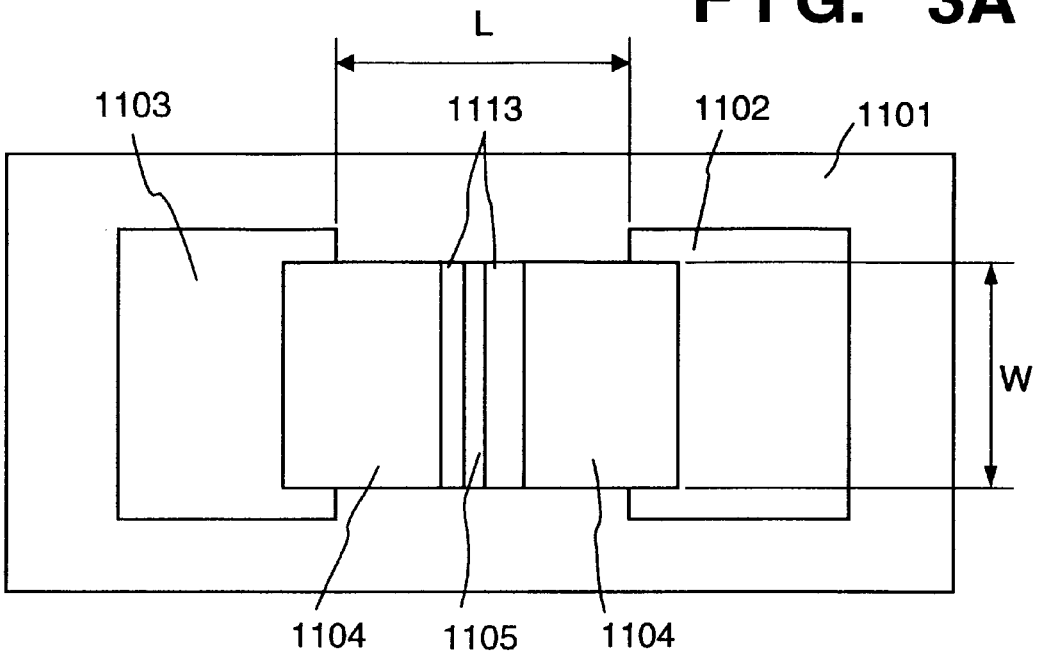
FIGS. 3A and 3B are plan and sectional views for explaining a plane type surface conduction electron-emitting device of the first embodiment.
Figure 3B:
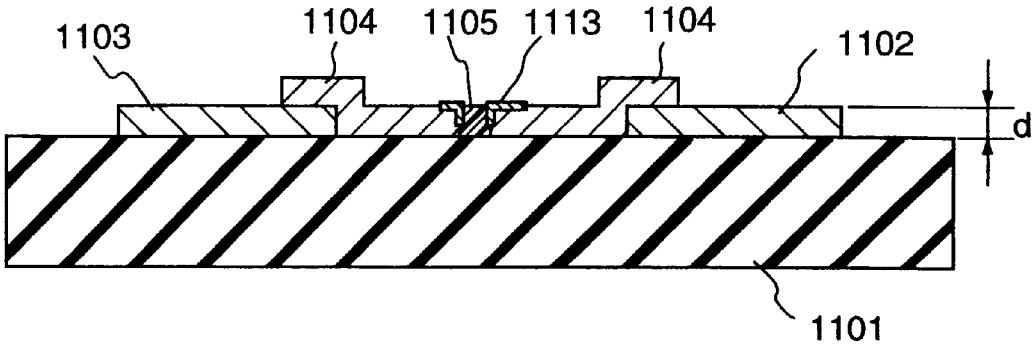

FIG. 3A is a plan view of the plane type surface conduction electron-emitting device. FIG. 3B is a sectional view of the plane type surface conduction electron-emitting device. The structure of the plane type surface conduction electron-emitting device will be described. Referring to FIGS. 3A and 3B, reference numeral 1101 denotes a substrate, 1102 and 1103 device electrodes, 1104 a conductive thin film, 1105 an electron-emitting portion formed by an energization forming process, and 1113 a thin film formed by an activation process.

As the substrate 1101, various glass substrates of, e.g., silica glass and soda-lime glass, various ceramic substrates of, e.g., alumina, or any of those substrates with an insulating layer consisting of, e.g., $SiO_2$ and formed thereon can be employed.

The device electrodes 1102 and 1103 formed on the substrate 1101 to be parallel to its surface and oppose each other are made of a conductive material. For example, one of the following materials may be selected and used: metals such as Ni, Cr, Au, Mo, W, Pt, Ti, Cu, Pd, and Ag, alloys of these materials, metal oxides such as $In_2O_3$—$SnO_2$, and semiconductors such as polysilicon. The electrodes can be easily formed by the combination of a film-forming technique such as vacuum deposition and a patterning technique such as photolithography or etching, however, any other method (e.g., a printing technique) may be employed.

The shape of the device electrodes 1102 and 1103 is appropriately designed in accordance with an application purpose of the surface conduction electron-emitting device. Generally, a spacing L between the device electrodes 1102 and 1103 is designed to be an appropriate value in a range from several hundreds Å to several hundreds $\mu$m. The most preferable range for an image display apparatus is from several $\mu$m to several tens $\mu$m. As for a thickness d of the device electrodes 1102 and 1103, an appropriate value is generally selected from a range from several hundreds Å to several $\mu$m.

The conductive thin film 1104 is made of a fine particle film. The "fine particle film" is a film which contains a lot of fine particles (including an insular aggregate). Microscopic observation of the fine particle film will reveal that the individual fine particles in the film are spaced apart from each other, adjacent to each other, or overlap each other.

One particle in the fine particle film has a diameter within a range from several Å to several thousands Å. Preferably, the diameter falls within a range from 10 Å to 200 Å. The thickness of the fine particle film is appropriately set in consideration of the following conditions: a condition necessary for electrical connection to the device electrode 1102 or 1103, a condition for the forming process to be described later, a condition for setting the electric resistance of the fine particle film itself to an appropriate value to be described later. More specifically, the thickness of the film is set in a range from several Å to several thousands Å, and more preferably, 10 Å to 500 Å.

For example, materials used for forming the fine particle film are metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, ZrC, HfC, TaC, SiC, and WC, nitrides such as TiN, ZrN, HfN, semiconductors such as Si and Ge, and carbons. An appropriate material is selected from these materials.

As described above, in this embodiment, the conductive thin film 1104 is formed using a fine particle film, and the sheet resistance of the film is set to fall within a range from $10^3$ to $10^7$ Ω/□.

As it is preferable that the conductive thin film 1104 is electrically connected to the device electrodes 1102 and 1103, they are arranged so as to partly overlap each other. Referring to FIGS. 3A and 3B, the respective parts are stacked in the following order from the bottom: the substrate 1101, the device electrodes 1102 (1103), and the conductive thin film 1104. This overlapping order may be: the substrate 1101, the conductive thin film 1104, and the device electrodes 1102 (1103), from the bottom.

The electron-emitting portion 1105 is a fissure portion formed at a part of the conductive thin film 1104. The electron-emitting portion 1105 has an electric resistance higher than that of the peripheral conductive thin film 1104. The fissure portion is formed by the energization forming process on the conductive thin film 1104. In some cases, particles, having a diameter of several Å to several hundreds Å, are arranged within the fissure portion. As it is difficult to exactly illustrate the actual position and shape of the electron-emitting portion 1105, FIGS. 3A and 3B show the fissure portion schematically.

The thin film 1113, which consists of carbon or a carbon compound, covers the electron-emitting portion 1105 and its peripheral portion. The thin film 1113 is formed by the activation process to be described later after the energization forming process.

The thin film 1113 is preferably made of monocrystalline graphite, polycrystalline graphite, amorphous carbon, or a mixture thereof, and its thickness is 500 Å or less, and more particularly, 300 Å or less.

As it is difficult to exactly illustrate the actual position or shape of the thin film 1113, FIGS. 3A and 3B show the film schematically. FIG. 3A is a plan view showing the device in which a part of the thin film 1113 is removed.

The preferred basic device structure of the surface conduction electron-emitting device of this embodiment has been described above. In this embodiment, actually, the following surface conduction electron-emitting device is used.

The substrate 1101 consists of soda-lime glass, and the device electrodes 1102 and 1103 an Ni thin film. The thickness d of the device electrodes 1102 and 1103 is 1,000 Å, and the electrode spacing L is 2 $\mu$m. As the main material for the fine particle film, Pd or PdO is used. The thickness and width W of the fine particle film are respectively set to about 100 Å and 100 $\mu$m.

A preferred method of manufacturing the plane type surface conduction electron-emitting device will be described next. FIGS. 4A to 4D are sectional views for explaining steps in manufacturing the plane type surface conduction electron-emitting device of this embodiment. The same reference numerals as in FIGS. 3A and 3B denote the same parts in FIGS. 4A to 4D, and a detailed description thereof will be omitted.

Figure 4A:
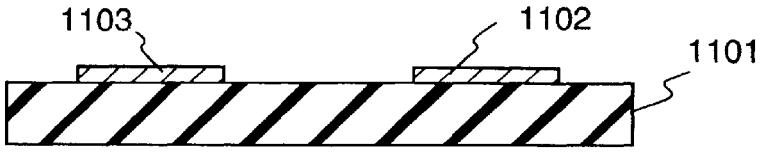
FIGS. 4A to 4D are sectional views for explaining steps in manufacturing the plane type surface conduction electron-emitting device of the first embodiment.

1) First, as shown in FIG. 4A, the device electrodes 1102 and 1103 are formed on the substrate 1101.

In forming these device electrodes 1102 and 1103, the substrate 1101 is fully cleaned with a detergent, pure water, and then an organic solvent, and a material for the device electrodes 1102 (1103) is deposited on the substrate 1101. As a depositing method, a vacuum film-forming technique such as deposition or sputtering may be used. Thereafter, the deposited electrode material is patterned by a photolithographic etching technique. Thus, the pair of device electrodes 1102 and 1103 in FIG. 4A are formed.

Figure 4B:
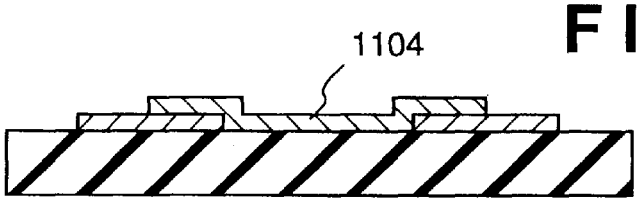

2) Next, as shown in FIG. 4B, the conductive thin film 1104 is formed.

In forming the conductive thin film 1104, an organic metal solution is applied to the substrate 1101 prepared in FIG. 4A first, and the applied solution is then dried and sintered, thereby forming a fine particle film. Thereafter, the fine particle film is patterned into a predetermined shape by the photolithographic etching method. The organic metal solution means an organic metal compound solution containing a material for fine particles, used for the conductive thin film 1104, as the main element. In this embodiment, Pd is used as the main element. In this embodiment, application of an organic metal solution is performed by a dipping method; however, a spinner method or spraying method may be used.

As a method of forming the conductive thin film 1104 made of the fine particle film, the application of an organic metal solution used in this embodiment can be replaced with any other method such as a vacuum deposition method, a sputtering method, or a chemical vapor deposition method.

Figure 4C:
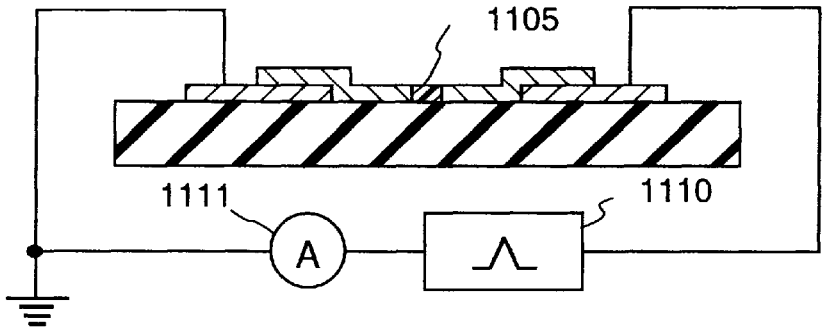

3) As shown in FIG. 4C, an appropriate voltage is applied between the device electrodes 1102 and 1103, from a power supply 1110 for the energization forming process, and the energization forming process is performed to form the electron-emitting portion 1105.

The energization forming process here is a process of performing electrification for the conductive thin film 1104 made of a fine particle film to appropriately destroy, deform, or deteriorate a part of the conductive thin film 1104, thereby changing the film 1104 into a structure suitable for electron emission. In the conductive thin film 1104 made of the fine particle film, the portion changed into the structure suitable for electron emission (i.e., the electron-emitting portion 1105) has an appropriate fissure in the thin film. Comparing the thin film having the electron-emitting portion 1105 with the thin film before the energization forming process, the electric resistance measured between the device electrodes 1102 and 1103 has greatly increased.

Figure 5:
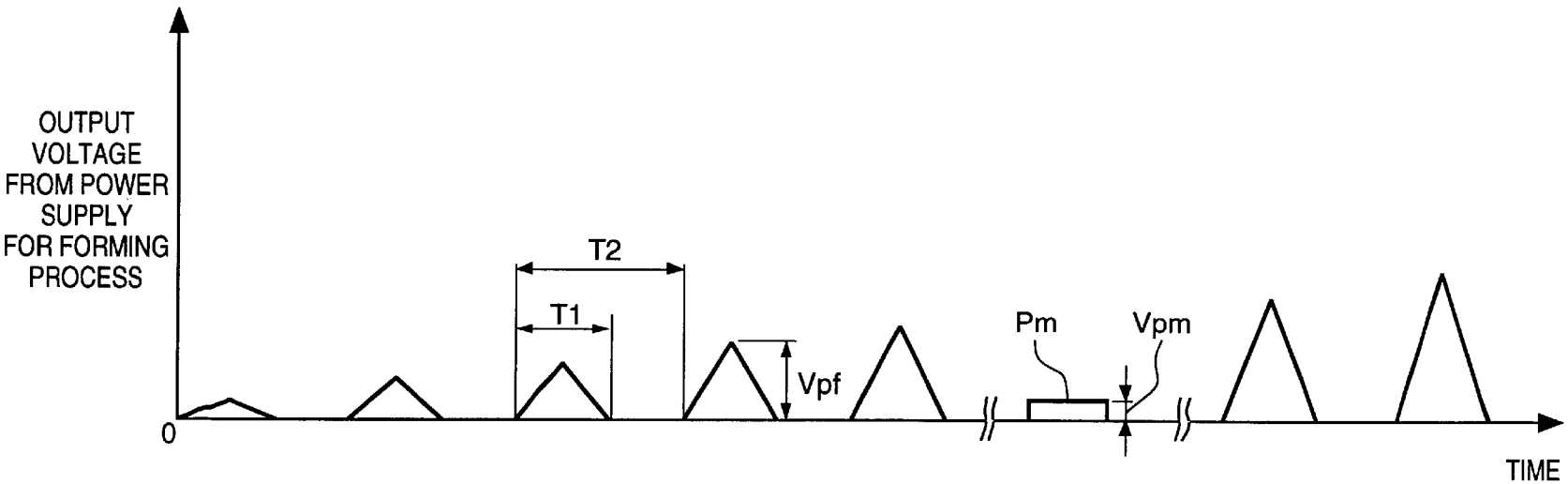
FIG. 5 is a graph showing an example of a voltage waveform applied in an energization forming process of the first embodiment.

An electrification method for the energization forming process will be described in detail with reference to FIG. 5 showing an example of the waveform of an appropriate voltage applied from the power supply 1110 for the energization forming process. In the energization forming process to the conductive thin film 1104 made of a fine particle film, a pulse-like voltage is preferably employed. In this embodiment, as shown in FIG. 5, a triangular pulse having a pulse width T1 is continuously applied at a pulse interval T2. In this case, a peak value Vpf of the triangular pulse is sequentially increased. Furthermore, a monitor pulse Pm is supplied between the triangular pulses at appropriate intervals to monitor the formed state of the electron-emitting portion 1105, and the current that flows at the supply of the monitor pulse Pm is measured by an ammeter 1111.

In this embodiment, in a $10^{-5}$ Torr vacuum atmosphere, the pulse width T1 is set to 1 msec, and the pulse interval T2 is set to 10 msec. The peak value Vpf is increased by 0.1 V, at each pulse. Each time five triangular pulses are applied, one monitor pulse Pm is supplied. To avoid adverse effects on the energization forming process, a voltage Vpm of the monitor pulse is set to 0.1 V. When the electric resistance between the device electrodes 1102 and 1103 becomes $1\times10^{6}$ Ω, i.e., the current measured by the ammeter 1111 upon application of the monitor pulse becomes $1\times10^{-7}$ A or less, electrification for the energization forming process is terminated.

Note that the above method is preferable to the surface conduction electron-emitting device of this embodiment. In case of changing the design of the surface conduction electron-emitting device concerning, e.g., the material or thickness of the fine particle film, or the spacing L between the device electrodes, the conditions for electrification are preferably changed in accordance with the change in device design.

Figure 4D:
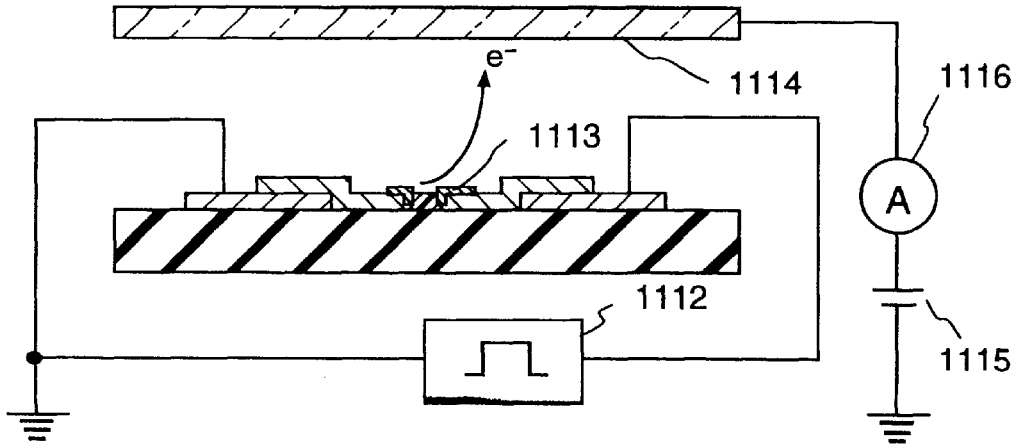

4) As shown in FIG. 4D, an appropriate voltage is applied next, from an activation power supply 1112, between the device electrodes 1102 and 1103, and the activation process is performed to improve the electron-emitting characteristic.

The activation process here is a process of performing electrification of the electron-emitting portion 1105 formed by the energization forming process, under appropriate conditions, to deposit a carbon or carbon compound around the electron-emitting portion 1105. (FIG. 4D shows the deposited material of the carbon or carbon compound as the material 1113.) Comparing the electron-emitting portion 1105 with that before the activation process, the emission current at the same applied voltage can be increased typically 100 times or more.

The activation process is performed by periodically applying a voltage pulse in a $10^{-4}$ to $10^{-5}$ Torr vacuum atmosphere to deposit a carbon or carbon compound mainly derived from an organic compound existing in the vacuum atmosphere. The deposition material 1113 is any of monocrystalline graphite, polycrystalline graphite, amorphous carbon, and a mixture thereof. The thickness of the deposition material 1113 is 500 Å or less, and more preferably, 300 Å or less.

Figure 6A:
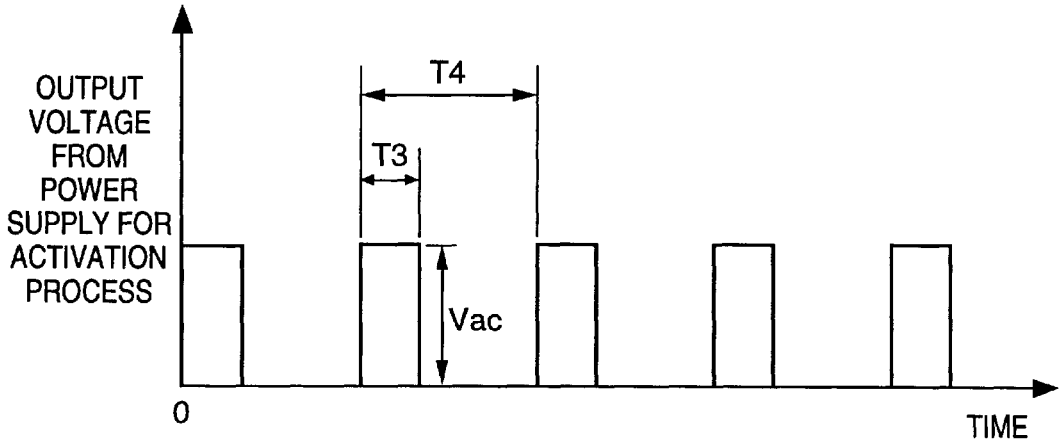
FIGS. 6A and 6B are graphs showing a voltage waveform applied in an activation process and an emission current in the first embodiment.

FIG. 6A shows an example of the waveform of an appropriate voltage applied from the activation power supply 1112 so as to explain the electrification method in FIG. 4D in more detail. In this embodiment, the activation process is performed by periodically applying a constant rectangular voltage. More specifically, a rectangular voltage Vac shown in FIG. 6A is set to 14 V; a pulse width T3, to 1 msec; and a pulse interval T4, to 10 msec.

Referring to FIG. 4D, reference numeral 1114 denotes an anode electrode connected to a DC high-voltage power supply 1115 and an ammeter 1116 to capture an emission current Ie emitted from the surface conduction electron-emitting device. Note that when the substrate 1101 is incorporated into the display panel before the activation process, the phosphor surface of the display panel is used as the anode electrode 1114.

Figure 6B:
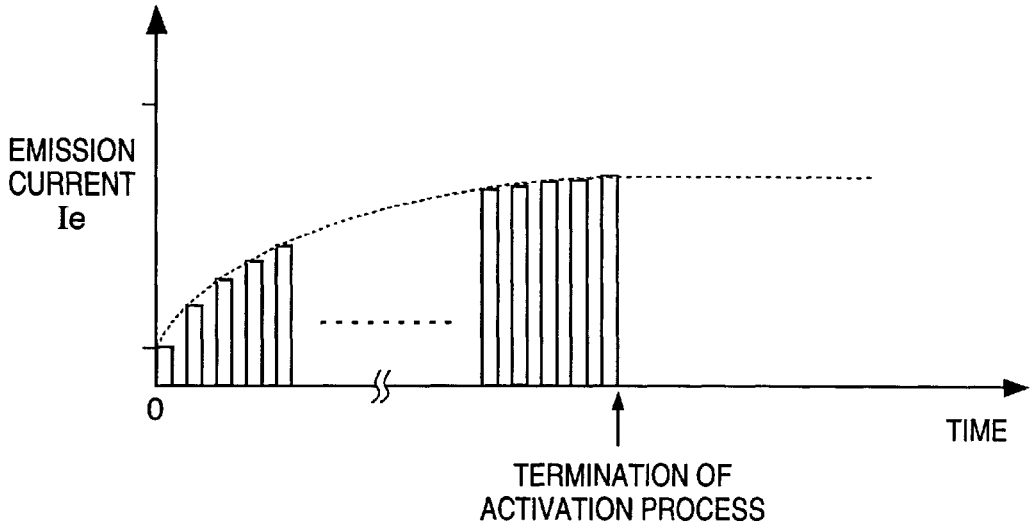

While applying a voltage from the activation power supply 1112, the ammeter 1116 measures the emission current Ie to monitor the progress of the activation process so as to control the operation of the activation power supply 1112. FIG. 6B shows an example of the emission current Ie measured by the ammeter 1116. As application of a pulse voltage from the activation power supply 1112 is started, the emission current Ie increases with the elapse of time, gradually reaches saturation, and rarely increases then. At the substantial saturation point of the emission current Ie, the voltage application from the activation power supply 1112 is stopped, and the activation process is then terminated.

Note that the above electrification conditions are preferable to manufacture the surface conduction electron-emitting device of this embodiment. When the design of the surface conduction electron-emitting device is changed, the conditions are preferably changed in accordance with the change in device design.

The plane type surface conduction electron-emitting device shown in FIGS. 3A and 3B is manufactured in the above manner.

<<Structure of Multi-electron Source Having Many Devices Wired in Simple Matrix>>

The structure of a multi-electron-beam source in which the above-described surface conduction electron-emitting devices are arranged on a substrate and wired in a simple matrix will be described below.

Figure 7:
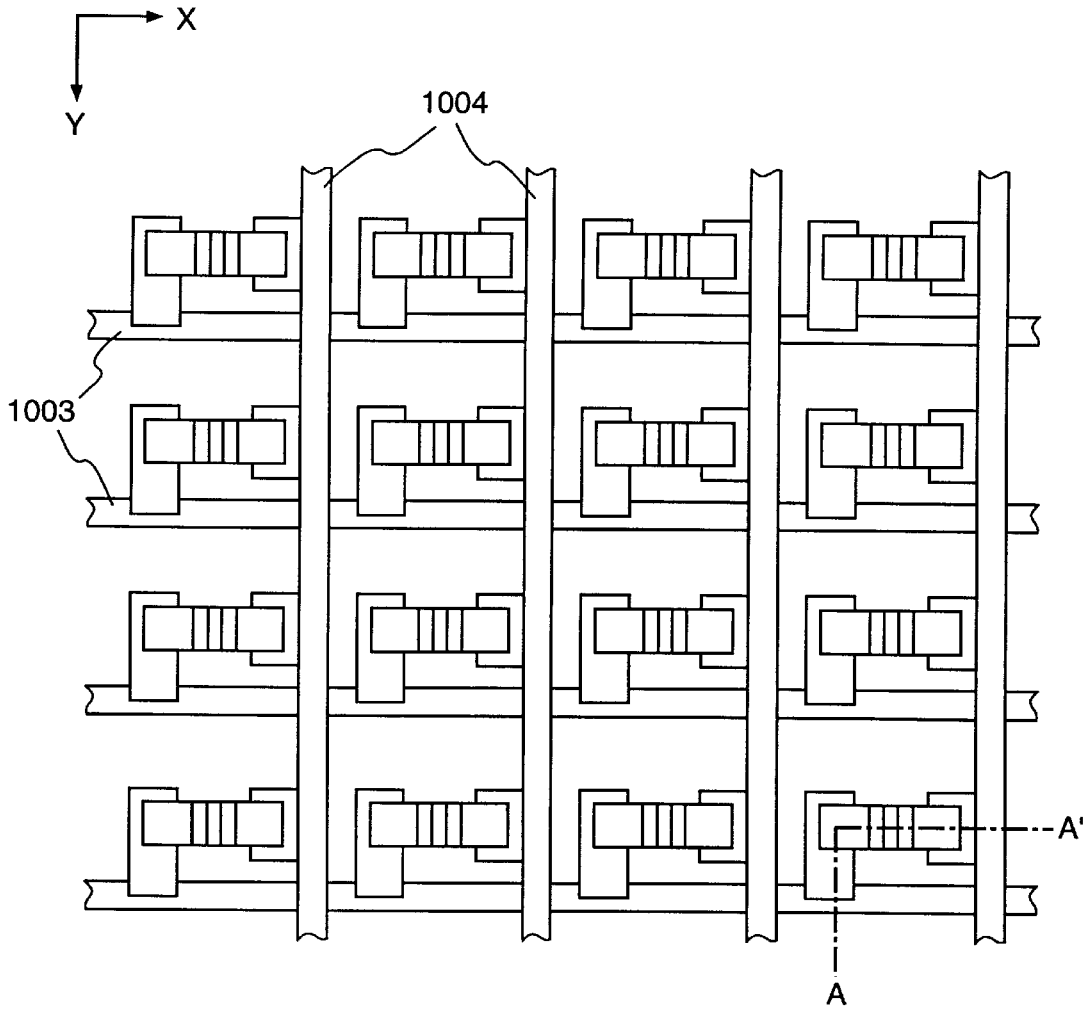
FIG. 7 is a plan view showing the substrate of a multi-electron-beam source of the first embodiment.

FIG. 7 is a plan view showing the multi-electron source used in the display panel shown in FIG. 1. The plane type surface conduction electron-emitting devices each having the same structure as described above are arranged on the substrate. These devices are wired in a simple matrix by the row wiring layers 1003 and the column wiring layers 1004. At intersections of the row wiring layers 1003 and the column wiring layers 1004, insulating layers (not shown) are formed between the wiring layers such that electrical insulation is maintained.

Figure 8:
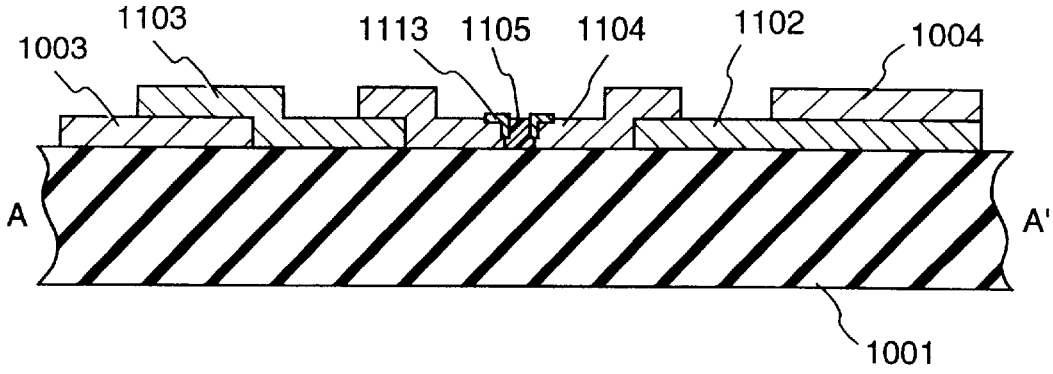
FIG. 8 is a partially sectional view of the substrate of the multi-electron source of the first embodiment.

FIG. 8 is a sectional view taken along a line A–A' in FIG. 7. The same reference numerals as in FIG. 7 denote the same parts in FIG. 8, and a detailed description thereof will be omitted.

The multi-electron source having the above structure is manufactured in the following manner. The row wiring layers 1003, the column wiring layers 1004, the interelectrode insulating layers (not shown), and the device electrodes and conductive thin films of the surface conduction electron-emitting devices are formed on the substrate in advance. Thereafter, a power is supplied to the respective devices through the row wiring layers 1003 and the column wiring layers 1004 by the method of the present invention to perform the energization forming process and the activation process, thereby manufacturing the multi-electron source.

<<Electron-emitting Characteristic Memory Function>>

The electron-emitting characteristic memory function of the surface conduction electron-emitting device, which is a feature of the present invention, will be described below.

In this embodiment, the surface conduction electron-emitting device itself is imparted with a function of storing its electron-emitting characteristic (to be referred to as an "electron-emitting characteristic memory function" hereinafter) such that a predetermined electron-emitting characteristic is stored in units of surface conduction electron-emitting devices.

A method of imparting the electron-emitting characteristic memory function to the surface conduction electron-emitting device and a method of setting a predetermined electron-emitting characteristic for each device and storing the electron-emitting characteristic into each device by using the memory function will be described below.

As the electron-emitting characteristic to be stored using the memory function, the electron-emitting efficiency is preferably high. For this purpose, the above-described activation process is preferably performed in advance to improve the electron-emitting characteristic.

To impart the electron-emitting characteristic memory function to the surface conduction electron-emitting device, predetermined ambient conditions must be set for the surface conduction electron-emitting device.

Improvement of the electron-emitting characteristic by the activation process will be described first.

As described above, when the electron-emitting portion of the surface conduction electron-emitting device is to be formed, a process (energization forming process) of flowing a current through the conductive thin film 1104 to partially destroy, deform, or deteriorate the thin film and form a fissure, is performed. Thereafter, the activation process is preferably performed. As described above, the activation process is a process of performing electrification of the electron-emitting portion 1105 formed by the energization forming process, under appropriate conditions, to deposit carbon or a carbon compound near the electron-emitting portion 1105. For example, in a vacuum atmosphere where an organic substance at an appropriate partial pressure exists, and the total pressure is $10^{-4}$ to $10^{-5}$ Torr, a voltage pulse is periodically applied. With this process, any one of monocrystalline graphite, polycrystalline graphite, amorphous carbon, and a mixture thereof is deposited near the electron-emitting portion 1105 to a thickness of 500 Å or less. The above vacuum atmosphere can be achieved by evacuating the vacuum vessel by using an oil diffusion pump or a rotary pump, though this atmosphere can also be achieved by evacuating the vacuum vessel by a vacuum pump using no oil and simultaneously introducing an organic gas. Various organic gases are available, including aromatic hydrocarbons. The type of gas and its partial pressure may be appropriately selected in accordance with the material and shape of the surface conduction electron-emitting device. In addition, the waveform of the voltage pulse to be applied may also be appropriately selected in accordance with the material and shape of the surface conduction electron-emitting device.

Comparing the surface conduction electron-emitting device after the activation process with that immediately after the energization forming process, the emission current at the same applied voltage can be increased typically 100 times or more.

The environment necessary for realizing the electron-emitting characteristic memory function will be described below.

To satisfactorily realize the memory function, the partial pressure of the organic gas in the vacuum atmosphere around the surface conduction electron-emitting device must be reduced not to newly deposit carbon or a carbon compound at the electron-emitting portion or its peripheral portion even when a voltage is applied to the surface conduction electron-emitting device, and this state must be maintained.

Preferably, the partial pressure of the organic gas in the atmosphere is reduced to $10^{-8}$ Torr or less, and this state is maintained. If possible, the partial pressure is preferably maintained at $10^{-10}$ Torr or less. Note that the partial pressure of the organic gas is obtained by integrating the partial pressures of organic molecules mainly consisting of carbon and hydrogen and having a mass number of 13 to 200, which is quantitatively measured using a mass spectrograph.

A typical method of reducing the partial pressure of the organic gas around the surface conduction electron-emitting device is as follows. The vacuum vessel incorporating the substrate on which the surface conduction electron-emitting device is formed is heated. While desorbing the organic gas molecules from the surface of each member in the vessel, vacuum evacuation is performed using a vacuum pump such as a sorption pump or an ion pump using no oil.

After the partial pressure of the organic gas is reduced in this manner, this state can be maintained by continuously performing evacuation using the vacuum pump with no oil. However, this method using the vacuum pump for continuous evacuation has disadvantages in volume, power consumption, weight, and cost depending on the application purpose. When the surface conduction electron-emitting devices are to be applied to an image display apparatus such as a display panel, the organic gas molecules are sufficiently desorbed to reduce the partial pressure of the organic gas, and thereafter, a getter film is formed in the vacuum vessel, and at the same time, the exhaust pipe is sealed, thereby maintaining the state.

In many cases, the origin of the organic gas remaining in the vacuum atmosphere is the vapor of an oil used in the vacuum exhaust unit such as a rotary pump or an oil diffusion pump or the residue of an organic solvent used in the manufacturing processes of the surface conduction electron-emitting device. Examples of the organic gas are aliphatic hydrocarbons such as alkane, alkene, and alkyne, aromatic hydrocarbons, alcohols, aldehydes, ketones, amines, phenols, organic acids such as carboxylic acid and sulfonic acid, or derivatives of the above-described organic substances: more specifically, butadiene, n-hexane, 1-hexene, benzene, toluene, O-xylene, benzonitrile, chloroethylene, trichloroethylene, methanol, ethanol, isopropanol, formaldehyde, acetaldehyde, acetone, methyl ethyl ketone, diethyl ketone, methylamine, ethylamine, acetic acid, and propionic acid.

The electron-emitting characteristic memory function exhibited by the surface conduction electron-emitting device in the above environment will be described below.

The present inventors drove a surface conduction electron-emitting device having undergone energization forming process and activation process in an atmosphere where the partial pressure of an organic gas was reduced and measured its electrical characteristics. FIGS. 9A, 9B, 10A, and 10B are graphs showing the electrical characteristics.

Figure 9A:
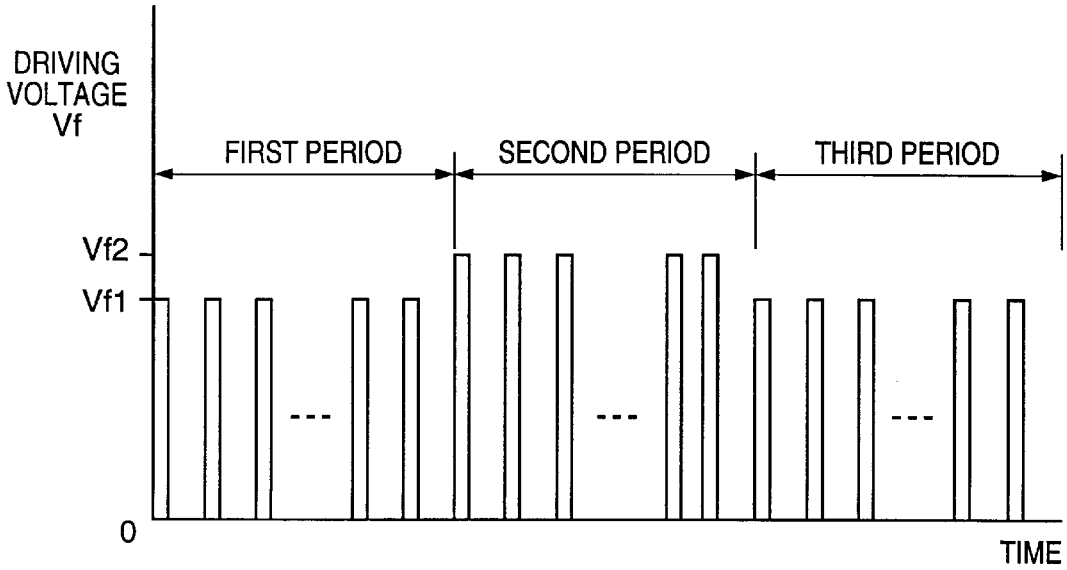
FIGS. 9A and 9B are graphs showing the voltage waveform of a characteristic shift signal supplied to obtain the characteristics of the surface conduction electron-emitting device of the first embodiment.
Figure 9B:
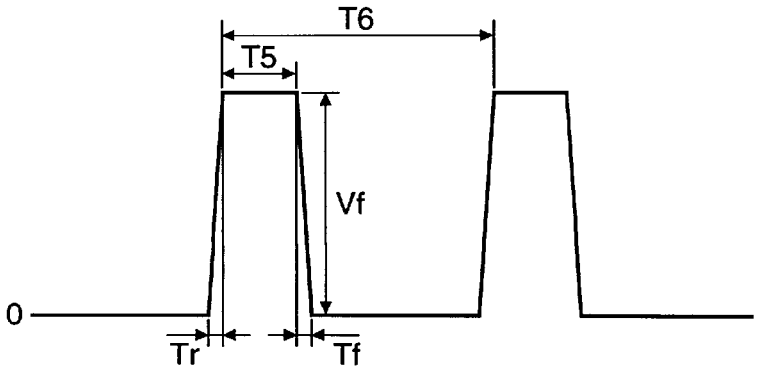

FIGS. 9A and 9B are graphs showing the voltage waveform of a driving signal applied to the surface conduction electron-emitting device. The abscissa represents the time axis; the ordinate represents the voltage (to be referred to as a device voltage Vf hereinafter) applied to the surface conduction electron-emitting device.

As shown in FIG. 9A, consecutive rectangular voltage pulses were used as a driving signal, and the application period of the voltage pulses was divided into three periods, namely first to third periods. In each period, 100 pulses having the same width and height were applied. FIG. 9B is an enlarged view of the waveform of such a voltage pulse.

Measurement conditions were: pulse width T5=66.8 μsec and pulse period T6=16.7 msec in each period. These conditions were determined with reference to the standard driving conditions set when a surface conduction electron-emitting device was applied to a general TV receiver. However, the memory function can be measured under other conditions. Note that measurement was performed while the impedance of a wiring path from a driving signal source to each surface conduction electron-emitting device was sufficiently reduced such that both a rise time Tr and a fall time Tf of a voltage pulse effectively applied to the surface conduction electron-emitting device became equal to or lower than 100 nsec.

The device voltage Vf was Vf=Vf1 in the first and third periods and was Vf=Vf2 in the second period. Both the voltages Vf1 and Vf2 were set to be higher than the electron emission threshold voltage of each surface conduction electron-emitting device and to satisfy Vf1<Vf2. Since the electron emission threshold voltage varies depending on the shape and material of a surface conduction electron-emitting device, these voltages are appropriately set in accordance with a surface conduction electron-emitting device to be measured.

With regard to an atmosphere around the surface conduction electron-emitting device in a measurement operation, the total pressure was $1\times10^{-6}$ Torr, and the partial pressure of an organic gas was $1\times10^{-9}$ Torr.

Figure 10A:
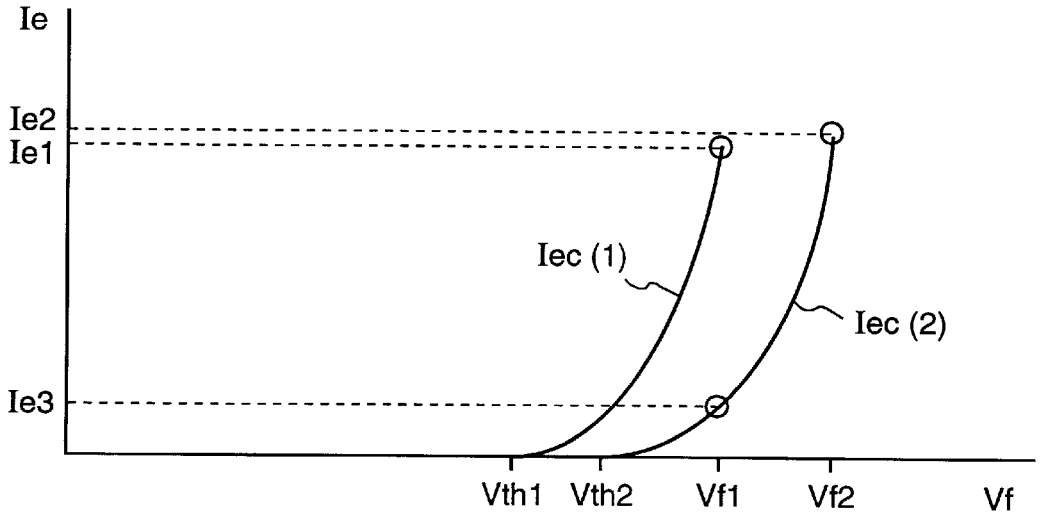
FIGS. 10A and 10B are graphs showing the electrical characteristics of the surface conduction electron-emitting device of the first embodiment.
Figure 10B:
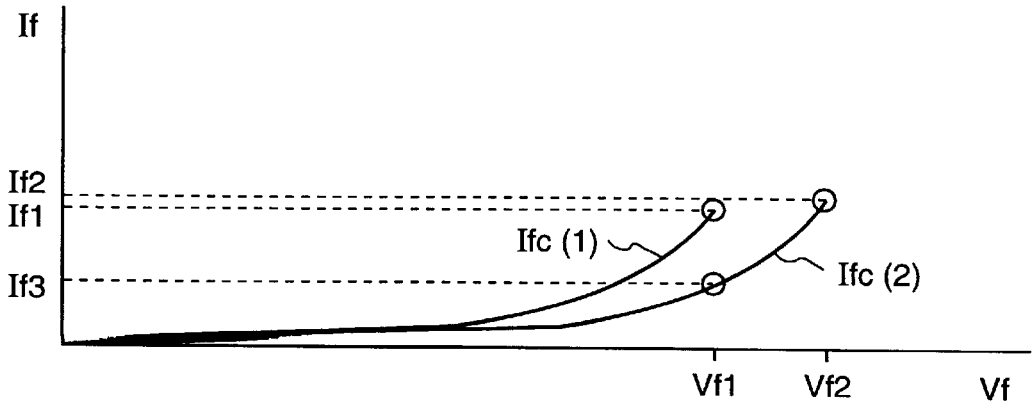

FIGS. 10A and 10B are graphs showing the electrical characteristics of the surface conduction electron-emitting device upon application of the driving signal shown in FIGS. 9A and 9B. Referring to FIG. 10A, the abscissa represents the device voltage Vf; the ordinate represents the measurement value of a current (to be referred to as an emission current Ie hereinafter) emitted from the surface conduction electron-emitting device. Referring to FIG. 10B, the abscissa represents the device voltage Vf; the ordinate represents the measurement value of a current (to be referred to as a device current If hereinafter) flowing in the surface conduction electron-emitting device.

The (device voltage Vf) vs. (emission current Ie) characteristic shown in FIG. 10A will be described first. In the first period, the surface conduction electron-emitting device outputs an emission current according to a characteristic curve Iec(1) in response to a driving pulse. In the rise time Tr of the driving pulse, when the applied voltage Vf exceeds Vth1, the emission current Ie abruptly increases according to the characteristic curve Iec(1). In the period of vf=Vf1, i.e., the interval T5, the emission current Ie is kept at Ie1. In the fall time Tf of the driving pulse, the emission current Ie abruptly decreases according to the characteristic curve Iec(1).

In the second period, when application of a pulse given by Vf=Vf2 is started, the characteristic curve Iec(1) changes to a characteristic curve Iec(2). More specifically, in the rise time Tr of the driving pulse, when the applied voltage Vf exceeds Vth2, the emission current Ie abruptly increases according to the characteristic curve Iec(2). In the period of Vf=Vf2, i.e., the interval T5, the emission current Ie is kept at Ie2. In the fall time Tf of the driving pulse, the emission current Ie abruptly decreases according to the characteristic curve Iec(2).

In the third period, although the pulse given by Vf=Vf1 is applied again, the emission current Ie changes according to the characteristic curve Iec(2). More specifically, in the rise time Tr of the driving pulse, when the applied voltage Vf exceeds Vth2, the emission current Ie abruptly increases according to the characteristic curve Iec(2). In the period of Vf=Vf1, i.e., the interval T5, the emission current Ie is kept at Ie3. In the fall time Tf of the driving pulse, the emission current Ie abruptly decreases according to the characteristic curve Iec(2).

As described above, in the third period, since the characteristic curve Iec(2) in the second period is stored in the surface conduction electron-emitting device, the emission current Ie becomes smaller than that in the first period.

With regard to the (device voltage Vf) vs. (device current If) characteristic as well, as shown in FIG. 10B, the surface conduction electron-emitting device operates according to a characteristic curve Ifc(1) in the first period. In the second period, however, the device operates according to a characteristic curve Ifc(2). In the third period, the device operates according to the characteristic curve Ifc(2) stored in the second period.

For the sake of descriptive convenience, only the three periods, i.e., the first to third periods, are set. As is apparent, however, the above phenomenon that the characteristic curve is stored is not limited to this condition. In applying a pulse voltage to a surface conduction electron-emitting device having a memory function, when a pulse having a voltage value larger than that of a previously applied pulse is applied, a characteristic curve of the device shifts, and the resultant characteristic is stored into the device. Subsequently, the characteristic of the device is kept stored unless a pulse having a larger voltage value is applied to the device. Such a memory function has not been observed in other emission devices including FE type emission devices. This function is therefore unique to a surface conduction electron-emitting device.

In this embodiment, when the multi-electron source having a large number of surface conduction electron-emitting devices is applied to a display panel, the memory function is positively utilized to enable appropriate white balance control.

More specifically, in this embodiment, the (emission current Ie) vs. (device voltage Vf) characteristic of each surface conduction electron-emitting device is set in accordance with the sensitivity of a corresponding phosphor and stored by the memory function.

More specifically, the characteristic of each surface conduction electron-emitting device is set in accordance with the (light emission luminance) vs. (irradiation current) characteristic of a corresponding color phosphor such that a desired color balance can be obtained. In this embodiment, phosphors of red (R), green (G) and blue (B), i.e., the three primary colors, are used, and the characteristic of each surface conduction electron-emitting device is stored such that a satisfactory white balance for the emission colors can be obtained when the same accelerating voltage is applied to the respective color phosphors, and at the same time, the same driving voltage is applied to the surface conduction electron-emitting devices for the respective colors to irradiate electron beams. For example, to set a white balance when the sensitivities (light emission luminance/irradiation current) of the three primary color phosphors are given as "G>R>B", the electron-emitting characteristics (the magnitude of the emission current Ie obtained upon application of the same voltage) of the surface conduction electron-emitting devices of the respective colors are set as "B device>R device>G device" and stored. That is, in FIGS. 10A and 10B, the characteristic curves of the respective color devices are set to be arranged in this order: B device, R device, and G device from left to right side, and stored.

For this purpose, the partial pressure of an organic gas in a vacuum atmosphere is sufficiently reduced, and thereafter, a voltage pulse is applied to each device for each color to store the electron-emitting characteristic. The peak values of voltage pulses to be applied are set to satisfy "G device>R device>B device". Note that 100 or more voltage pulses are preferably applied for the memory function such that the electron-emitting characteristic to be stored is stabilized. For descriptive convenience, only a qualitative description has been made above. In fact, however, the shift amount of each characteristic curve was quantitatively set on the basis of the sensitivity ratio of the respective color phosphors and the characteristic curve of the corresponding surface conduction electron-emitting device, so that the peak value of the voltage pulse for the memory function was quantitatively determined.

As described above, after different electron-emitting characteristics are stored in units of surface conduction electron-emitting devices for the respective colors, the devices are driven on the basis of image information to practically perform image display. At this time, the maximum voltage of the driving signal is suppressed to the peak value or less of the memory voltage pulse such that the driving signal applied to the devices for display does not shift the stored characteristic curve. To maintain the memory function even during image display, the partial pressure of the organic gas component in the vacuum atmosphere is kept low, as a matter of course.

<<White Balance Control>>

While balance control of this embodiment will be described below in more detail.

Figure 11:
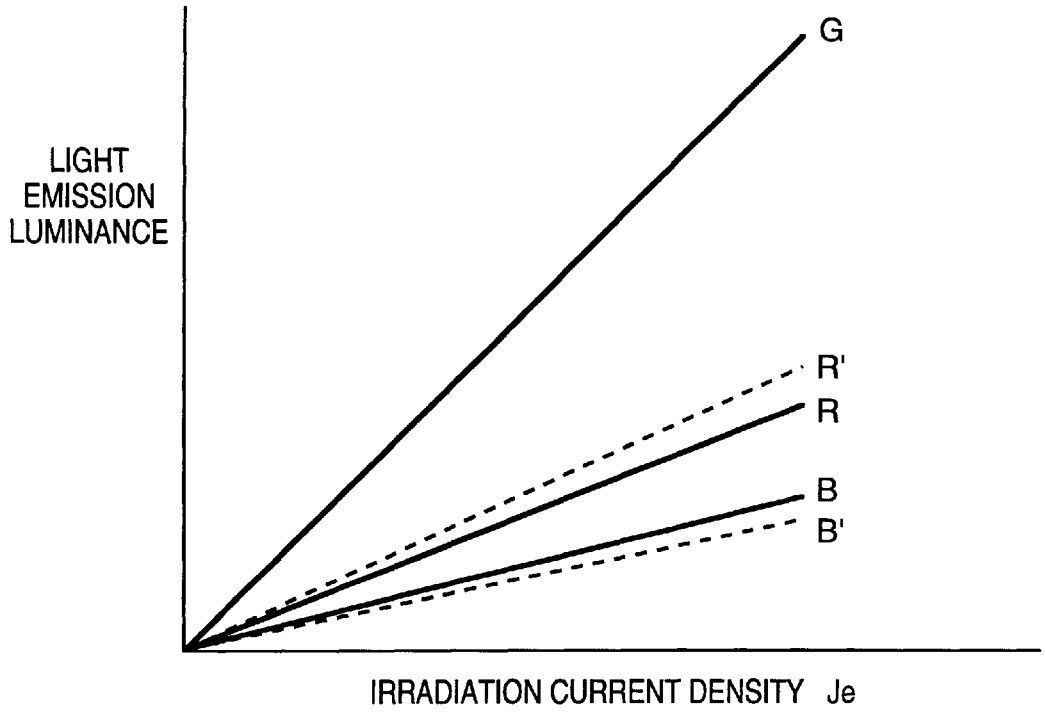
FIG. 11 is a graph for explaining a method of obtaining a white balance of the respective color phosphors in the first embodiment.
Figure 26A:
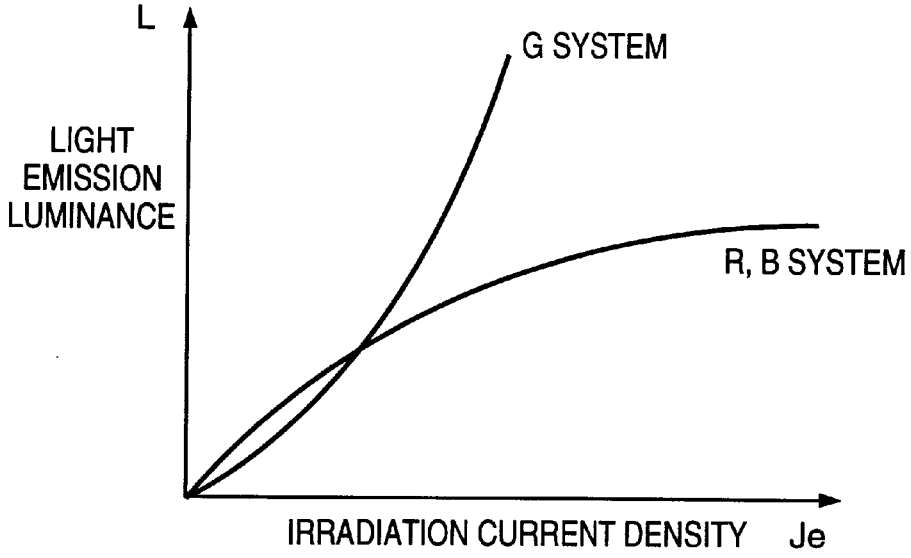
FIGS. 26A and 26B are graphs showing the typical light-emitting characteristics of respective color phosphors.
Figure 26B:
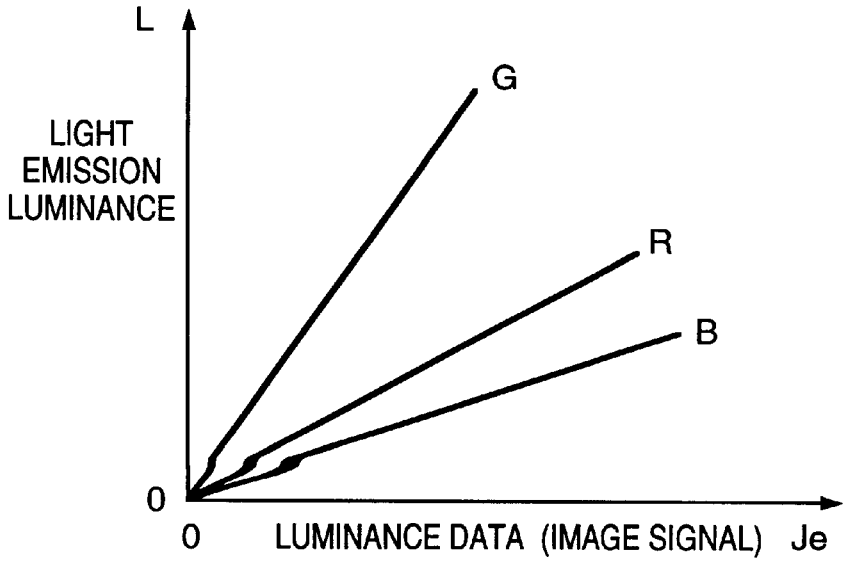

A storing process of changing the electron-emitting characteristic of the surface conduction electron-emitting device of this embodiment will be described below with reference to FIGS. 11 and 12. In this embodiment, the partial pressure of an organic gas in the display panel is reduced in the above-described manner, and thereafter, the electron-emitting characteristic of each surface conduction electron-emitting device is corrected using the memory function. First, the electron-emitting characteristic to be corrected in accordance with the light emission characteristic of each of the red (R), green (G) and blue (B) phosphors is examined in advance. More specifically, assume that since the surface conduction electron-emitting devices are arranged in correspondence with the R, G and B phosphors of the phosphor film 1008 in FIG. 1, the electron-emitting characteristics of the surface conduction electron-emitting devices are uniform. In this case, the light emission luminance characteristics of the respective colors with respect to an irradiation current Je as shown in FIG. 26B can be obtained. In FIG. 11, the R, G and B light emission luminance curves indicated by solid curves are the same as the characteristic curves shown in FIG. 26B. In FIG. 11, when the irradiation current densities Je from the surface conduction electron-emitting devices are identical, light emission luminance curves R' and B' are obtained by plotting the R and B light emission luminances for attaining a white balance referring to the G light emission luminance, as a result of color mixing by light emission from the R, G and B phosphors. The curves R' and B' will be referred to as reference light emission luminance curves hereinafter.

Depending on the light emission luminance characteristic of a phosphor to be used, the reference light emission luminance characteristic curve R' for obtaining the white balance shifts from the actual light emission luminance characteristic curve R, as shown in FIG. 11. This also applies to the reference light emission luminance characteristic curve B' and the actual light emission luminance characteristic curve B of the B phosphor. Therefore, an amount corresponding to the shift between the reference light emission luminance characteristic curve and the actual light emission luminance characteristic curve is the electron-emitting characteristic to be corrected.

A method of changing the electron-emitting characteristic will be described below in detail with reference to FIG. 12.

Figure 12:
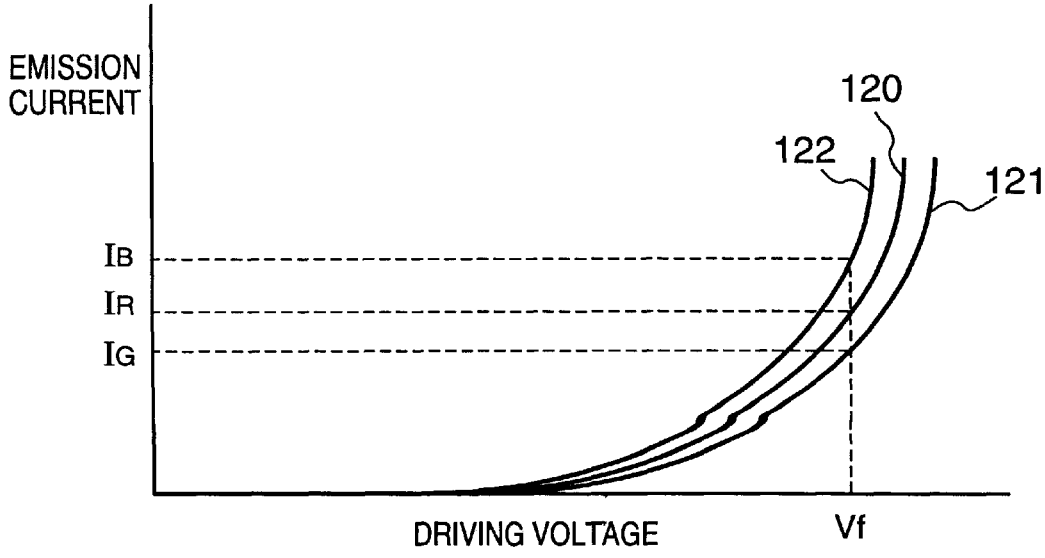
FIG. 12 is a graph for explaining a method of changing the electron-emitting characteristics of the surface conduction electron-emitting devices corresponding to the respective color phosphors in the first embodiment.

Referring to FIG. 12, a curve 120 represents the electron-emitting characteristic of a surface conduction electron-emitting device group corresponding to R phosphors, a curve 121 the electron-emitting characteristic of a surface conduction electron-emitting device group corresponding to G phosphors, and a curve 122 the electron-emitting characteristic of a surface conduction electron-emitting device group corresponding to B phosphors.

As described above, when memory voltage pulses each having a different maximum peak value Vmax are applied in advance to the surface conduction electron-emitting devices of the respective colors, the electron-emitting characteristics can be changed. A memory voltage pulse having a maximum peak value Vmax-R is applied to the device group having the electron-emitting characteristic 120, a memory voltage having a maximum peak value Vmax-G is applied to the device group having the electron-emitting characteristic 121, and a memory voltage pulse having a maximum peak value Vmax-B is applied to the device group having the electron-emitting characteristic 122. With this operation, the electron-emitting characteristic curves of the respective colors as shown in FIG. 12 can be obtained. As is apparent from the above description, Vmax-B<Vmax-R<Vmax-G. The emission current values at the peak value Vf of the driving pulse are given as IG<IR<IB.

As described above, according to this embodiment, the electron-emitting characteristics of the surface conduction electron-emitting device groups of the respective colors are changed. With this processing, the light emission luminance curves G, R and B in FIG. 11 can be adjusted to match the light emission luminance curves G, R' and B' for obtaining a white balance.

The present inventors prepared a surface conduction electron-emitting device while setting the device electrode spacing L=3 $\mu$m and the electron-emitting portion width W=300 $\mu$m. Under conditions that the distance between the anode and the surface conduction electron-emitting device was 4 mm, the vacuum in the vacuum vessel was $1\times10^{-9}$ Torr (the partial pressure of an organic material: $1\times10^{-10}$ Torr or less), and the potential of the anode electrode was 1 kV, the electron-emitting characteristic was measured. As a result, when the peak value of a memory pulse was 15.0 V, the emission current was 1.4 $\mu$A. When the peak value was 15.3 V, the emission current was 0.7 $\mu$A. When the peak value was 15.6 V, the emission current was 0.5 $\mu$A. These emission currents were measured by applying the voltage Vf=14.0 V.

As described above, according to this embodiment, different memory waveforms are applied to the surface conduction electron-emitting devices in accordance with the light emission luminance characteristics of the corresponding phosphors in advance, thereby changing the electron-emitting characteristics of each surface conduction electron-emitting device. With this processing, the white balance of the phosphors can be easily made optimum.

<<Description of Display Operation>>

An arrangement for actually performing a display operation on the display panel prepared in the above manner will be described below.

Figure 13:
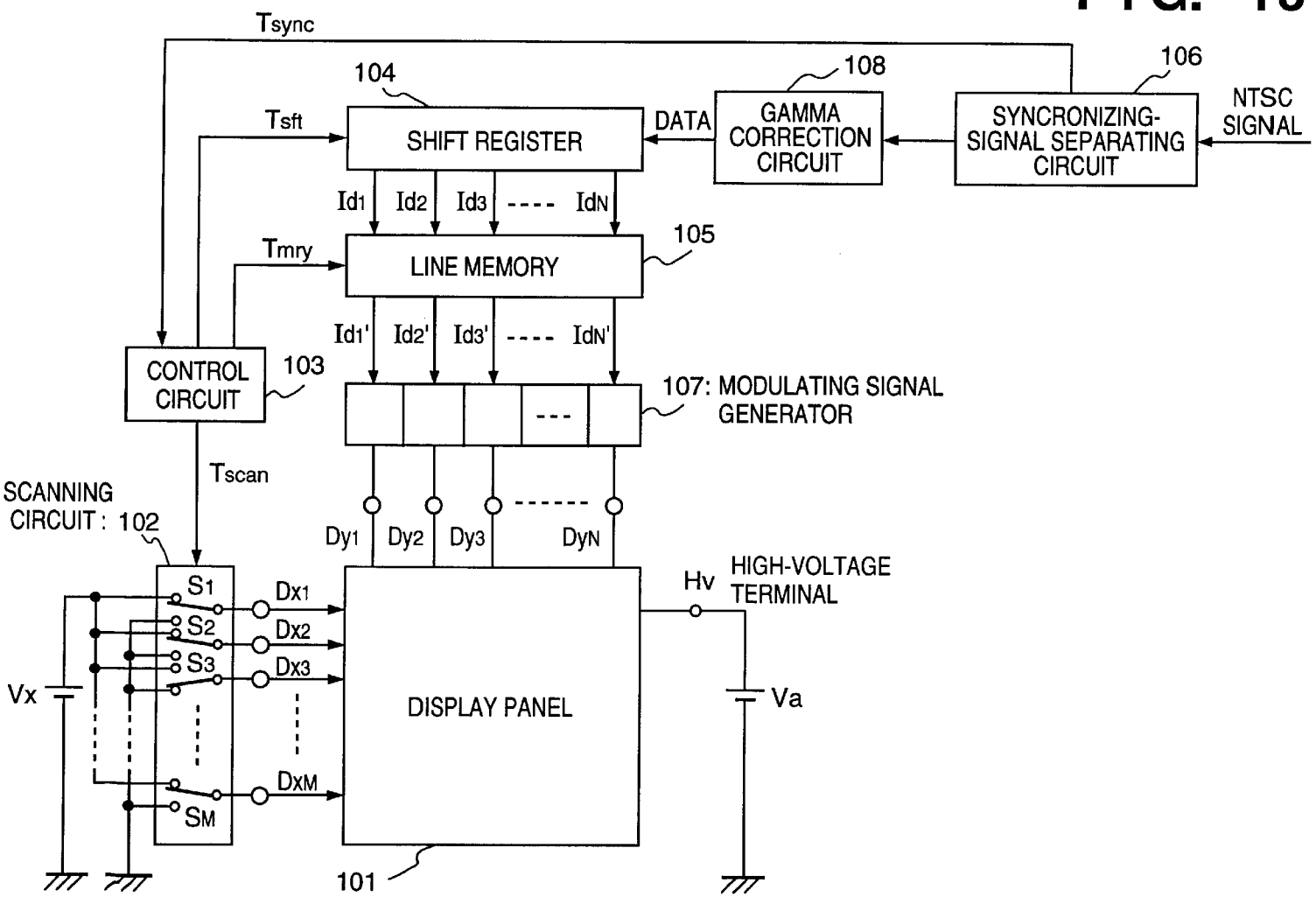
FIG. 13 is a block diagram schematically showing the arrangement of a driving circuit for performing television display on the display panel of the first embodiment.

FIG. 13 is a block diagram schematically showing the arrangement of a driving circuit for performing TV display on the basis of an NTSC TV signal. Referring to FIG. 13, reference numeral 101 denotes the display panel, 102 a scanning circuit, 103 a control circuit, 104 a shift register, 105 a line memory, 106 a synchronizing-signal separating circuit, 107 a modulating signal generator, and 108 a gamma correction circuit. Reference symbols Vx and Va denote DC voltage sources. The functions of the respective components will be described below. The display panel 101 is connected to an external electronic circuit through the terminals Dx1 to DxM, the terminals Dy1 to DyN, and the high-voltage terminal Hv. Scanning signals for sequentially driving the surface conduction electron-emitting device groups arranged in the multi-electron source in the display panel 101, i.e., in an M×N matrix one row (N devices) at a time are supplied to the terminals Dx1 to DxM. Modulating signals for controlling output electron beams from the respective surface conduction electron-emitting devices of one row which is selected by the scanning signals are supplied to the terminals Dy1 to DyN. A DC voltage of, e.g., 10 kV is applied from the DC voltage source Va to the high-voltage terminal Hv. This DC voltage is an accelerating voltage for imparting the electron beams output from the surface conduction electron-emitting devices with sufficient energy to excite the phosphors.

The scanning circuit 102 will be described next. The scanning circuit 102 incorporates M switching devices (schematically illustrated by S1 to SM in FIG. 13). Each of the switching devices selects the output voltage of the DC voltage source Vx or 0 V (ground level) and electrically connects the selected voltage to a corresponding one of the terminals Dx1 to DxM of the display panel 101. The switching devices S1 to SM operate on the basis of a control signal Tscan output from the control circuit 103. The switching devices can be easily constituted by combining switching devices such as FETs.

The DC voltage source Vx of this embodiment is set, based on the characteristics of the surface conduction electron-emitting devices, to output a constant voltage of 7 V.

The control circuit 103 acts to coordinate the operation of each component so as to present an appropriate display on the basis of an externally input image signal. On the basis of a synchronizing signal Tsync sent from the synchronizing-signal separating circuit 106 (to be described below), the control circuit 103 generates control signals Tscan, Tsft, and Tmry to each of the components. The timing of each control signal will be described later in detail with reference to FIG. 18.

The synchronizing-signal separating circuit 106 is a circuit for separating a synchronizing signal component and a luminance signal component from an externally input NTSC television signal. As is well known, the synchronizing-signal separating circuit 106 can be easily constituted using a frequency separating circuit (filter). The synchronizing signal separated by the synchronizing-signal separating circuit 106 comprises a vertical synchronizing signal and a horizontal synchronizing signal, as is well known. For descriptive convenience, these signals are represented by the signal Tsync. The luminance signal component of the image, which is separated from the TV signal, is subjected to gamma correction by the gamma correction circuit 108. The corrected signal is represented by a DATA signal, for descriptive convenience. This DATA signal is sequentially input to the shift register 104. The shift register 104 converts the DATA signal as a serial signal into a parallel signal in units of lines of the image and operates on the basis of the control signal Tsft sent from the control circuit 103. The control signal Tsft may be referred to as the shift clock of the shift register 104.

The serial/parallel-converted data of one line of the image (corresponding to drive data of N surface conduction electron-emitting devices) is output from the shift register 104 as N parallel signals Id1 to IdN. The line memory 105 is a memory for storing one line of image data for a requisite period of time. The line memory 105 appropriately stores the contents of Id1 to IdN in accordance with the control signal Tmry sent from the control circuit 103. The stored contents are output as I'd1 to I'dN and input to the modulating signal generator 107. The modulating signal generator 107 is a signal source for appropriately modulating and driving each of the surface conduction electron-emitting devices in accordance with the image data I'd1 to I'dN. The output signals from the modulating signal generator 107 are supplied to the surface conduction electron-emitting devices in the display panel 101 through the terminals Dy1 to DyN.

As described above, in this embodiment, predetermined electron-emitting characteristics are stored in the respective surface conduction electron-emitting devices in accordance with the luminous efficiencies of the R, G and B, i.e., three primary color phosphors. In this embodiment, when the electron-emitting characteristics are stored in the surface conduction electron-emitting devices, voltage pulses of 15.0 V, 15.3 V, and 15.6 V are used. As described above, the voltage of a display driving signal must be controlled not to exceed the voltage of the memory pulse such that the stored electron-emitting characteristics are not shifted upon displaying an image. More specifically, the voltage of the driving signal for image display is set to 14.0 V for all the surface conduction electron-emitting devices. The luminance of the image is modulated by changing the pulse width (i.e., the length along time axis) of the driving signal.

The functions of the respective components shown in FIG. 13 have been described above. Before a description of an entire operation, the operation of the display panel 101 will be described in more detail with reference to FIGS. 14 to 17. For illustrative convenience, the number of pixels of the display panel 101 is set to 6×6 (i.e., M=N=6). As is apparent, however, the display panel 101 to be actually used has a much larger number of pixels.

Figure 14:
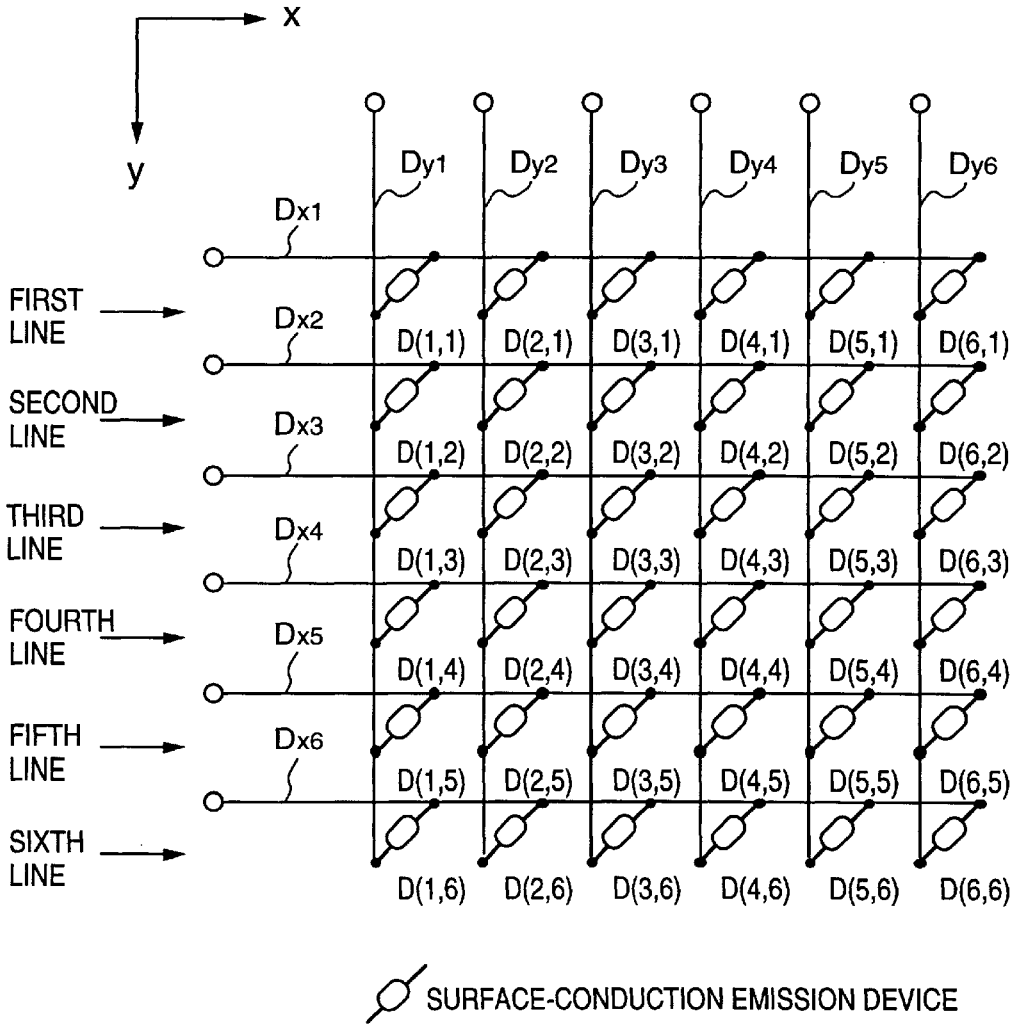
FIG. 14 is a partial circuit diagram of a 85 in which the surface conduction electron-emitting devices are wired in a matrix.

FIG. 14 is a circuit diagram showing a multi-electron-beam source in which surface conduction electron-emitting devices are wired in a 6×6 matrix. The positions of the respective devices are represented by (X,Y) coordinates: D(1,1), D(1,2), . . . , and D(6,6).

When an image is to be displayed by driving such a multi-electron-beam source, the image is sequentially formed in units of lines parallel to the X-axis. To drive surface conduction electron-emitting devices corresponding to one line of the image, of the terminals Dx1 to Dx6, the terminal of the row corresponding to the display line is supplied with a voltage of 0 V, and the remaining terminals are supplied with a voltage of 7 V. In synchronism with this operation, modulating signals are supplied to the terminals Dy1 to Dy6 in accordance with the image pattern of the display line.

Figure 15:
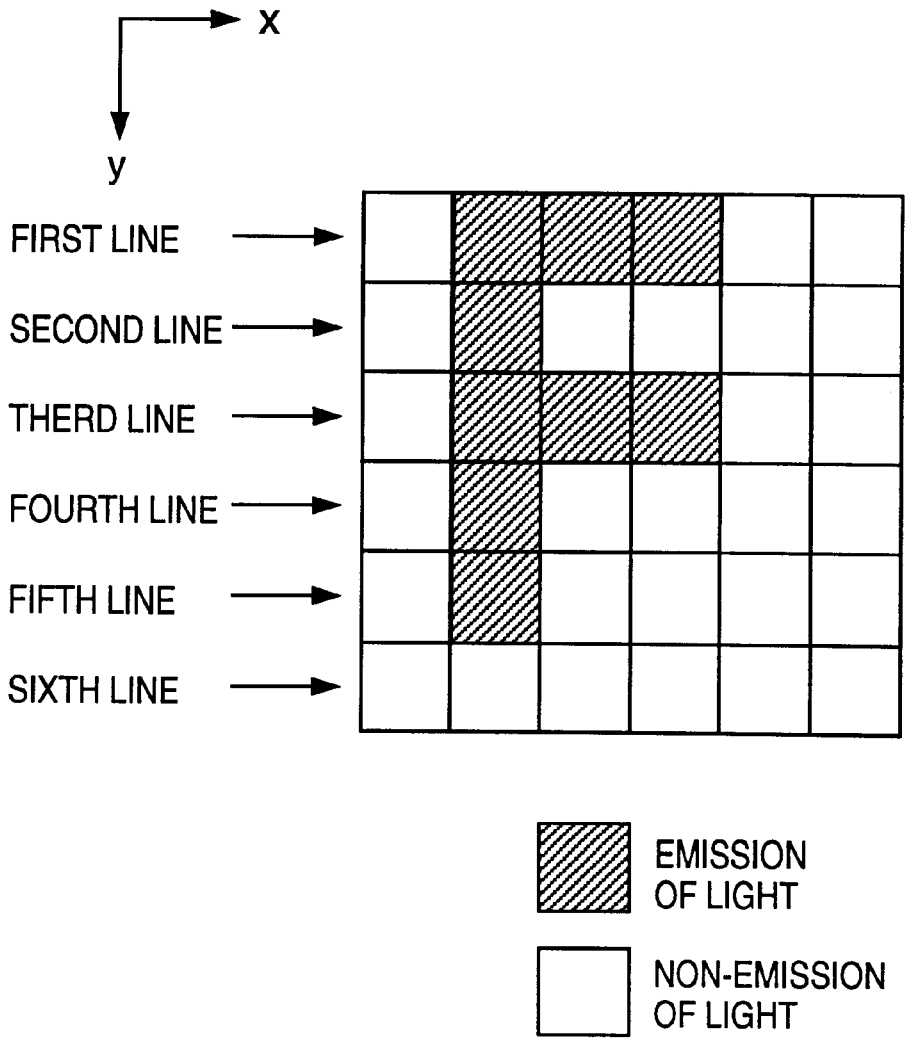
FIG. 15 is a view showing an example of an original image.

An example will be described in which an image pattern as shown in FIG. 15 is displayed. For descriptive convenience, the luminances of the light-emitting portions of the image pattern equal each other and correspond to, e.g., 100 [ftxL]. In the display panel 101, a known P-22 was used as a phosphor, the accelerating voltage was 10 kV, the repeating frequency of the image display was 60 Hz, and the surface conduction electron-emitting devices having the above characteristics were used as emission devices. In this case, a voltage of 14 V is suitable (this voltage value changes when the respective parameters are changed).

Figure 16:
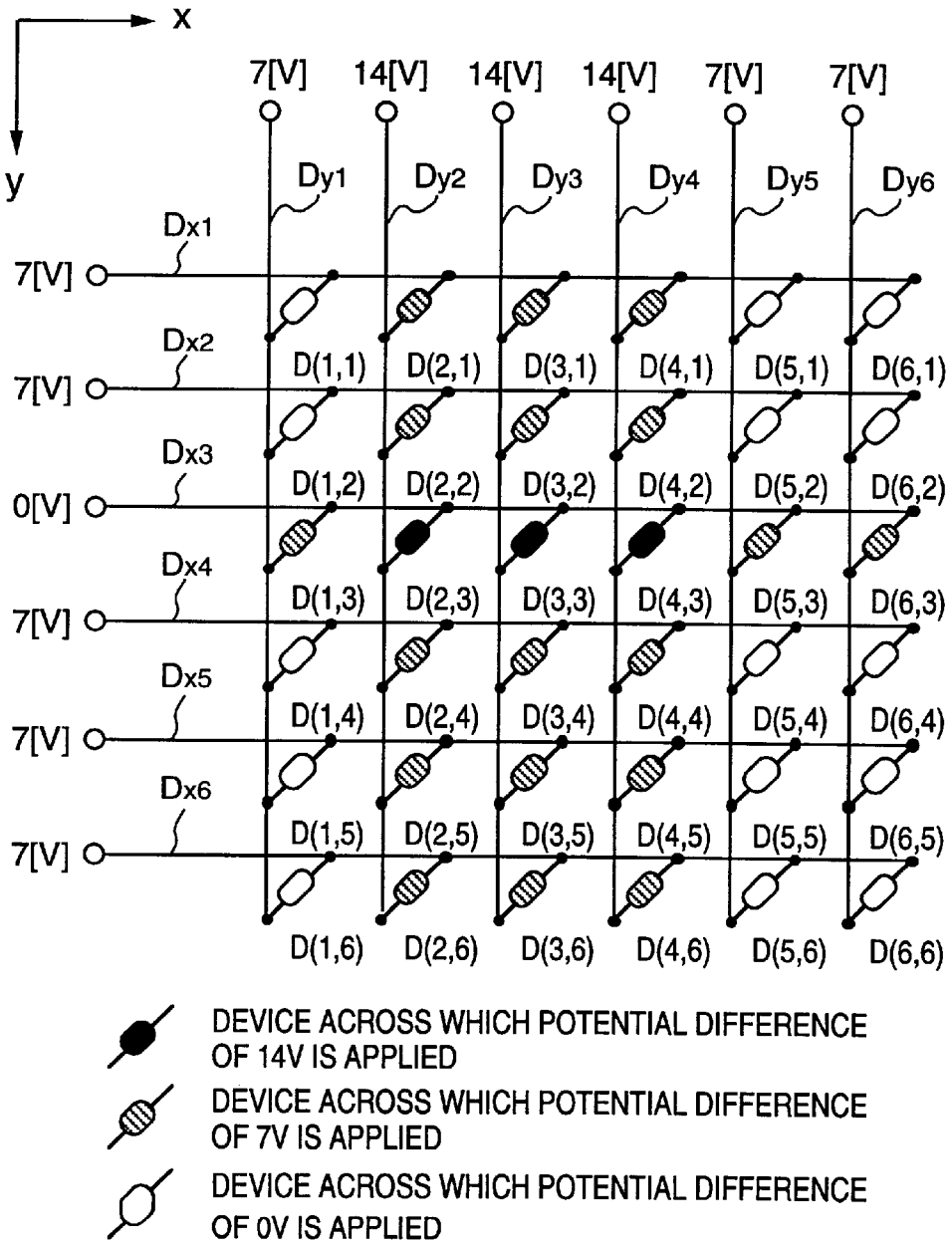
FIG. 16 is a view showing the values of driving voltages applied to the multi-electron source.

For the image shown in FIG. 15, a period for light emission of the third line will be described. FIG. 16 is a view showing voltage values applied to the multi-electron source through the terminals Dx1 to Dx6 and Dy1 to Dy6 while light is emitted from the third line of the image shown in FIG. 15. As is apparent from FIG. 16, the surface conduction electron-emitting devices D(2,3), D(3,3), and D(4,3) are applied with a voltage of 14 V and output electron beams. The remaining devices are applied with a voltage of 7 V (hatched devices in FIG. 16) or 0 V (white devices in FIG. 17). These voltages are lower than the electron emission threshold voltage, so no electron beams are output from these devices.

Figure 17:
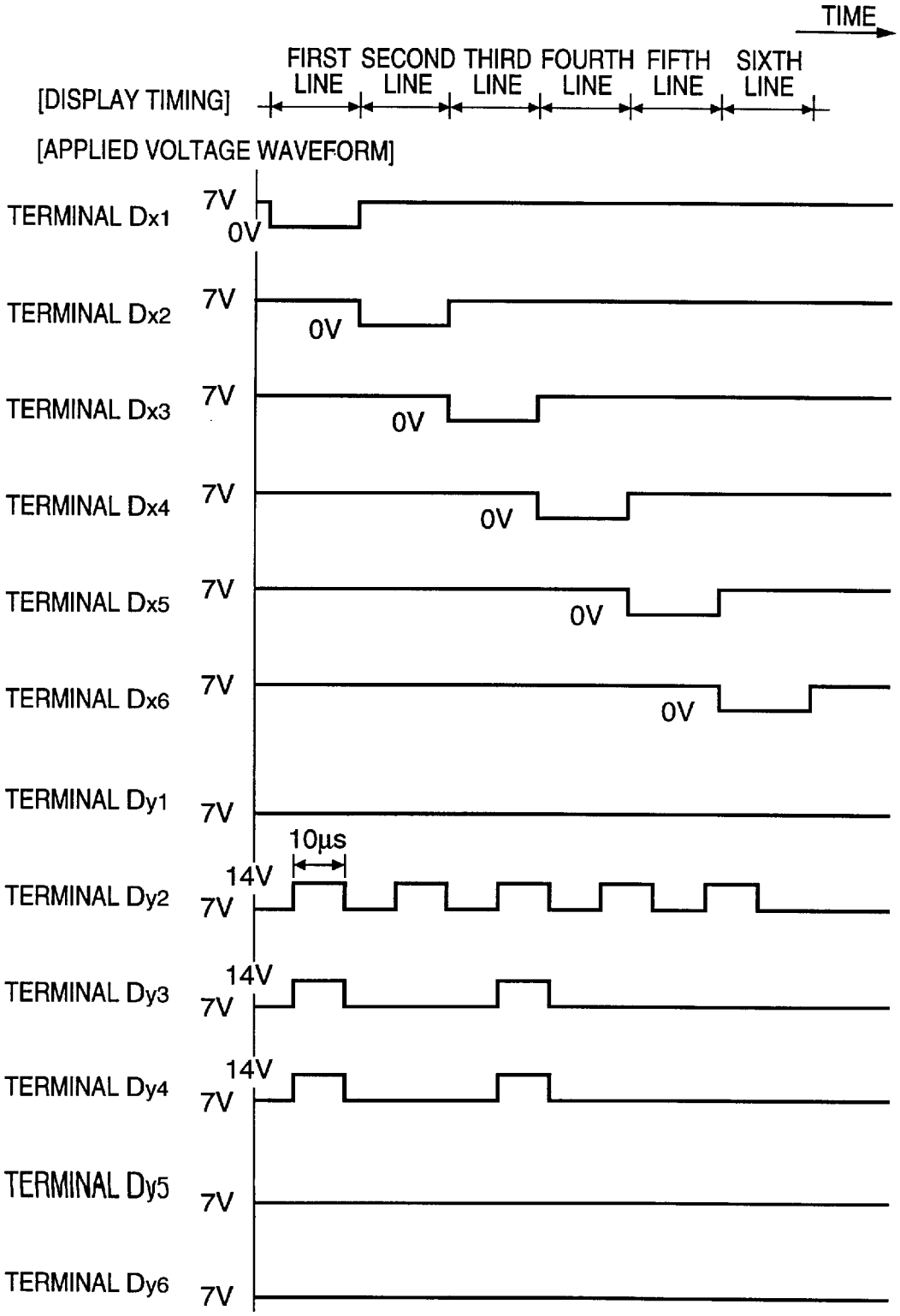
FIG. 17 is a timing chart of the multi-electron source which sequentially performs display in units of lines.

For the remaining lines as well, the multi-electron source is driven in a similar manner in accordance with the display pattern shown in FIG. 15. FIG. 17 is a timing chart time-serially showing this driving operation. As shown in FIG. 17, when the multi-electron source is sequentially driven from the first line, an image display free from flicker can be realized.

To change the light emission luminance of the display pattern, i.e., to increase (reduce) the luminance, the length of the pulse of the modulating signal applied to the terminals Dy1 to Dy6 is made larger (smaller) than 10 $\mu$s. With this operation, modulation is enabled.

The method of driving the display panel 101 using the multi-electron source with 6×6 pixels has been described above. The entire operation of the apparatus shown in FIG. 13 will be described below with reference to the timing charts of FIGS. 18A–18F.

Figure 18A:
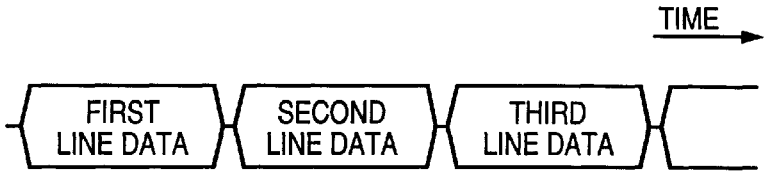
FIGS. 18A–18F are timing charts of the driving circuit shown in FIG. 13.
Figure 18B:
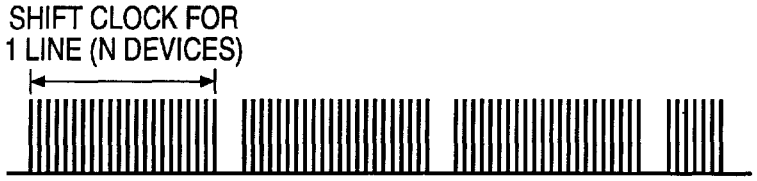
Figure 18C:
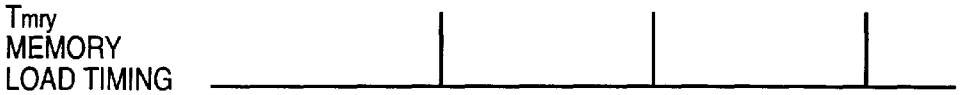
Figure 18D:
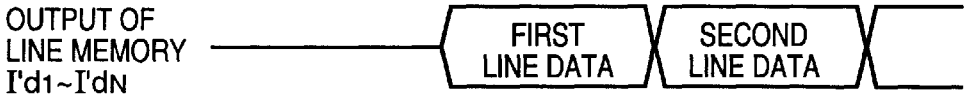

Referring to FIGS. 18A–18F, FIG. 18A represents the timing of the luminance signal DATA separated from the externally input NTSC signal by the synchronizing-signal separating circuit 106 and corrected by the gamma correction circuit 108. The DATA signal is sequentially sent in the order of the first line, the second line, the third line, . . . . In synchronism with this operation, the shift clock Tsft is output from the control circuit 103 to the shift register 104, as shown in FIG. 18B. When the data of one line is accumulated in the shift register 104, the memory write signal Tmry is output from the control circuit 103 to the line memory 105, at a timing as shown in FIG. 18C, so that the drive data of one line (for N devices) is stored and held. As a result, the contents of I'd1 to I'dN as output signals from the line memory 105 are changed at the timing in FIG. 18D.

Figure 18E:
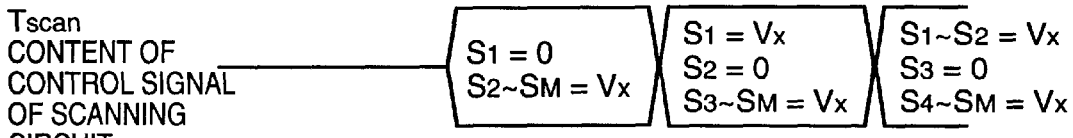
Figure 18F:
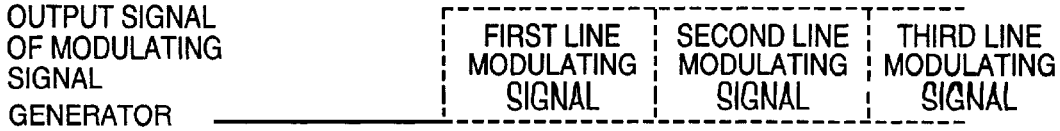

On the other hand, the contents of the control signal Tscan for controlling the operation of the scanning circuit 102 are represented by the timing as shown in FIG. 18E. More specifically, when the first line is to be driven, only the switching device S1 in the scanning circuit 102 is applied with the voltage of 0 V, and the remaining switching devices are applied with the voltage of 7 V. When the second line is to be driven, only the switching device S2 is applied with the voltage of 0 V, and the remaining switching devices are applied with the voltage of 7 V. This applies to all the lines in the above manner, and the operation is controlled in units of lines. In synchronism with this operation, a modulating signal is output from the modulating signal generator 107 to the display panel 101 at the timing shown in FIG. 18F.

Although no description has been made, the shift register 104 and the line memory 105 can be either of a digital signal type or of an analog signal type as long as serial/parallel conversion or storage of the image signal is performed at a predetermined speed and timing. In the case of a digital signal type, the output signal DATA from the gamma correction circuit 108 must be converted into a digital signal. This processing can be easily realized by arranging an A/D converter at the output portion of the correction circuit 108, as a matter of course.

With the above-described operation, the NTSC signal can be displayed using the display panel 101, so that TV display is enabled.

In this embodiment, plane type surface conduction electron-emitting devices are used for the display panel 101. However, even when step type surface conduction electron-emitting devices are used, a satisfactory color balance can be obtained. The step type surface conduction electron-emitting device will be briefly described below.

<<Step Type Surface conduction electron-emitting device>>

Another typical surface conduction electron-emitting device having an electron-emitting portion or its peripheral portion formed of a fine particle film, i.e., a step type surface conduction electron-emitting device, will be described below.

Figure 19:
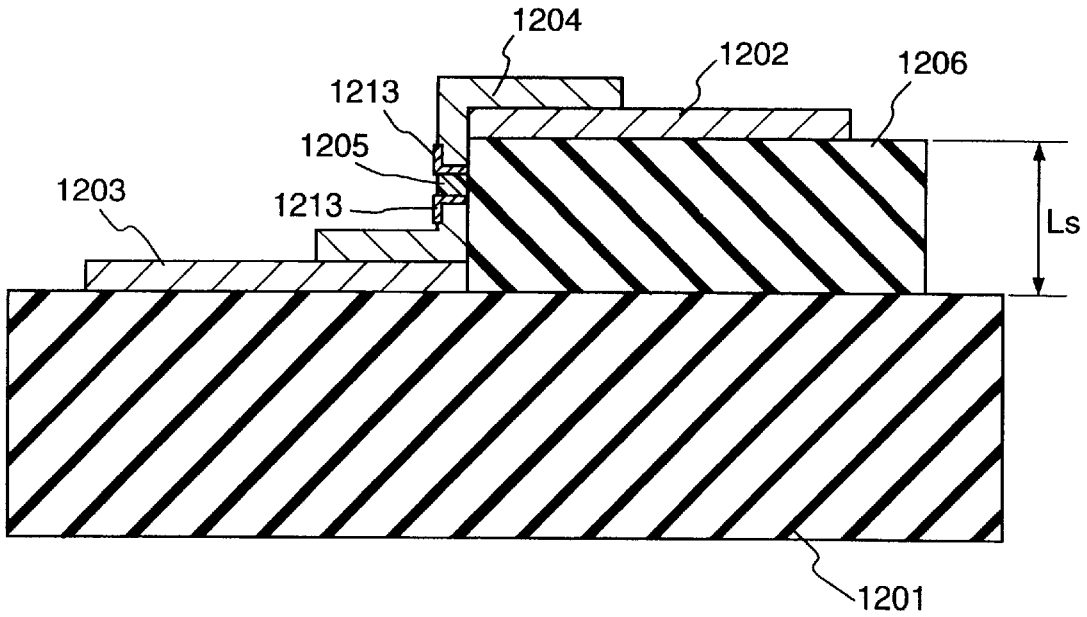
FIG. 19 is a sectional view of a step type surface conduction electron-emitting device of the first embodiment.

FIG. 19 is a sectional view for explaining the basic arrangement of the step type surface conduction electron-emitting device. Referring to FIG. 19, reference numeral 1201 denotes a substrate, 1202 and 1203 device electrodes, 1206 a step forming member (insulating layer), 1204 a conductive thin film using a fine particle film, 1205 an electron-emitting portion formed by an energization forming process, and 1213 a thin film formed by an activation process.

The step type surface conduction electron-emitting device differs from the plane type surface conduction electron-emitting device described above in that one device electrode (1202) is formed on the step forming member 1206, and the conductive thin film 1204 covers a side surface of the step forming member 1206. Therefore, the device electrode spacing L of the plane type surface conduction electron-emitting device shown in FIG. 3A corresponds to a step height Ls of the step forming member 1206 of the step type surface conduction electron-emitting device. For the substrate 1201, the device electrodes 1202 and 1203, and the conductive thin film 1204 using a fine particle film, the same materials as enumerated in the description of the plane type surface conduction electron-emitting device can be used. For the step forming member 1206, an electrically insulating material such as $SiO_2$ is used.

A preferred method of manufacturing the step type surface conduction electron-emitting device will be described below. FIGS. 20A to 20E are sectional views for explaining steps in manufacturing the step type surface conduction electron-emitting device of this embodiment. The same reference numerals as in FIG. 19 denote the same members in FIGS. 20A to 20E, and a detailed description thereof will be omitted.

Figure 20A:
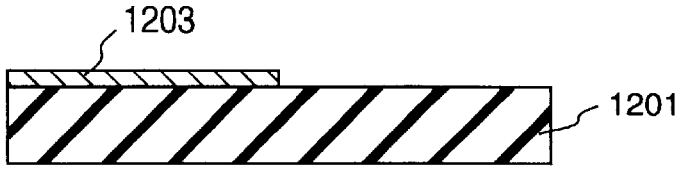
FIGS. 20A to 20E are sectional views for explaining steps in manufacturing the step type surface conduction electron-emitting device of the first embodiment.

1) As shown in FIG. 20A, the device electrode 1203 is formed on the substrate 1201.

Figure 20B:
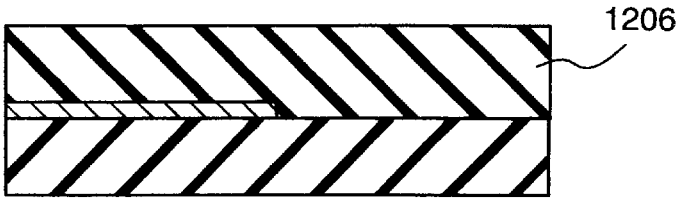

2) As shown in FIG. 20B, the insulating layer 1206 for forming the step forming member is stacked on the resultant structure. For the insulating layer 1206, e.g., an $SiO_2$ layer is formed by sputtering. However, another film-forming method such as vacuum deposition or printing may be used.

Figure 20C:
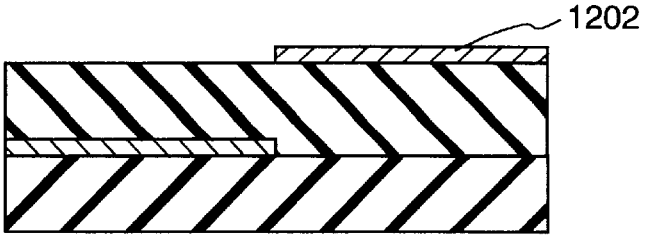

3) As shown in FIG. 20C, the device electrode 1202 is formed on the insulating layer 1206.

Figure 20D:
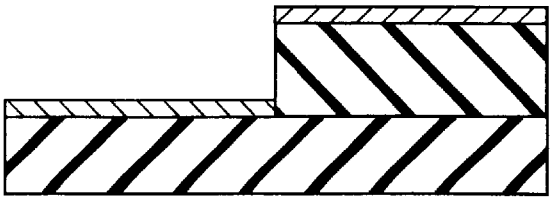

4) As shown in FIG. 20D, part of the insulating layer 1206 is removed by, e.g., etching to expose the device electrode 1203.

Figure 20E:
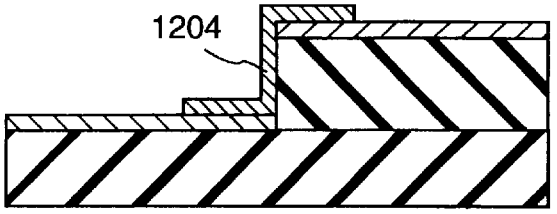

5) As shown in FIG. 20E, the conductive thin film 1204 using a fine particle film is formed. To form the conductive thin film 1204, a film-forming method such as a coating method can be used, as in the plane type surface conduction electron-emitting device.

6) As in the plane type surface conduction electron-emitting device, an energization forming process is performed to form an electron-emitting portion 1205. That is, the same energization forming process as that of the plane type surface conduction electron-emitting device, which has been described with reference to FIG. 4C, is performed.

7) As in the plane type surface conduction electron-emitting device, an activation process is performed to deposit carbon or a carbon compound near the electron-emitting portion 1205. That is, the same activation process as that of the plane type surface conduction electron-emitting device, which has been described with reference to FIG. 4D, is performed.

In this embodiment, in the above-described manner, the step type surface conduction electron-emitting device shown in FIG. 19 is manufactured.

As described above, according to this embodiment, the electron-emitting characteristics of each surface conduction electron-emitting device having a memory function are appropriately stored in correspondence with a corresponding phosphor color. With this arrangement, the white balance of light emission of the R, G and B, i.e., three primary color, phosphors can be appropriately set.

<Second Embodiment>

The second embodiment of the present invention will be described below.

In the first embodiment, a display panel using surface conduction electron-emitting devices arranged in a simple matrix has been described. In the second embodiment as well, a display panel is constituted by surface conduction electron-emitting devices each having a memory function and phosphors, as in the first embodiment, though the surface conduction electron-emitting devices are wired to be parallel to each other.

Figure 21:
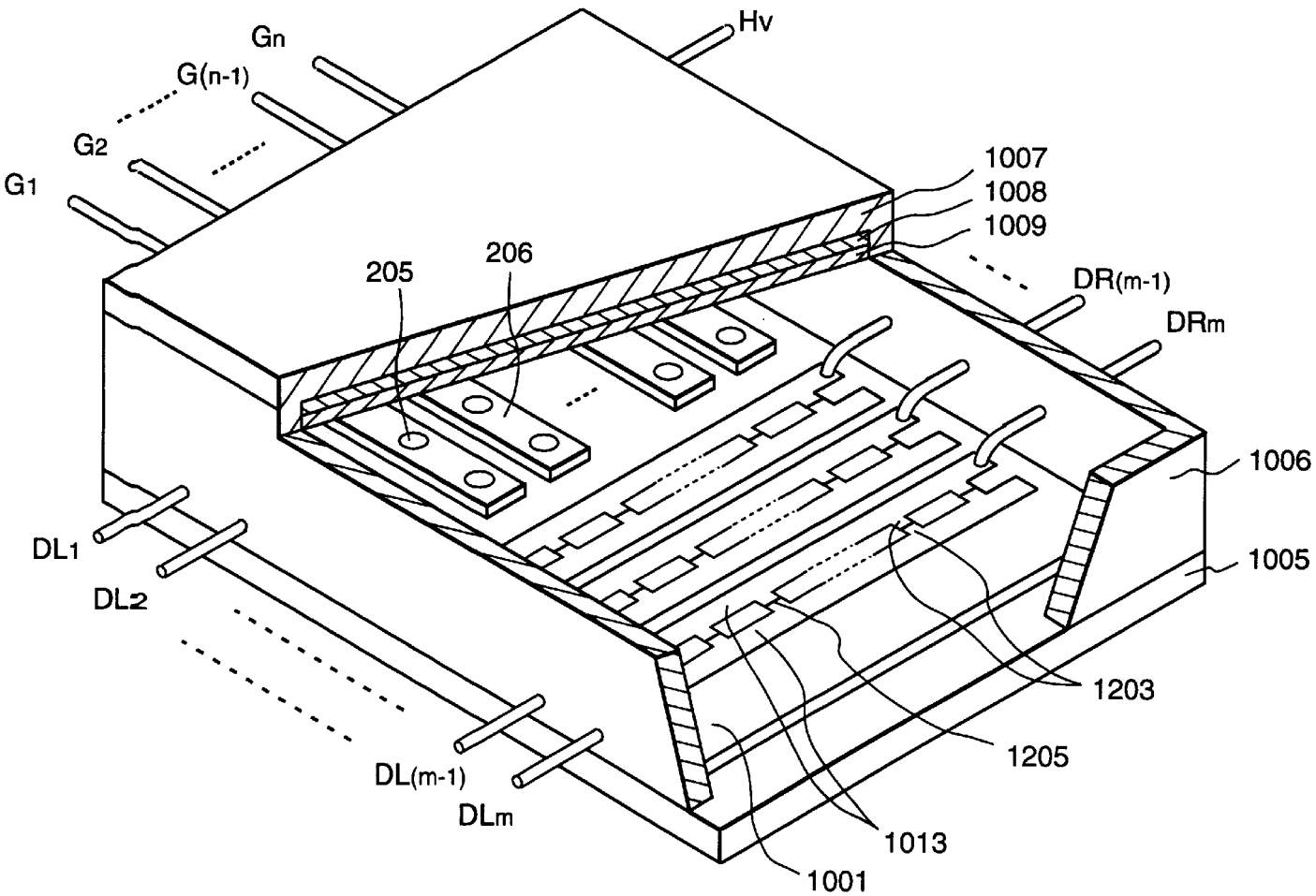
FIG. 21 is a partially cutaway perspective view of a display panel to which the second embodiment of the present invention is applied.

FIG. 21 is a partially cutaway perspective view of a display panel according to the second embodiment, showing the internal structure of the panel. The same reference numerals as in FIG. 1 denote the same parts in FIG. 21, and a detailed description thereof will be omitted.

The display panel shown in FIG. 21 has a structure disclosed in, e.g., Japanese Patent Laid-Open No. 1-31332 filed by the present applicant. More specifically, a lot of surface conduction electron-emitting devices are arranged parallel to one another on a substrate 1001. Two ends of each device are connected to row wiring layers 1013, respectively, and the substrate 1001 having a lot of such rows is fixed on a rear plate 1005. Thereafter, grids 206 each having electron pass holes 205 are arranged above the substrate 1001 to be substantially perpendicular to the aligning direction of the surface conduction electron-emitting devices.

Other structures are almost the same as those of the display panel shown in FIG. 1, and a detailed description thereof will be omitted. In the second embodiment, phosphors 92 are striped, as shown in FIG. 2A. The phosphors 92 are arranged along the aligning direction of the surface conduction electron-emitting devices (i.e., to be substantially perpendicular to the grids). Black stripes are formed in advance, and the respective color phosphors 92 are applied between the black stripes, thereby forming a phosphor film 1008. In a color display, a face plate 1007, a supporting frame 1006, and the rear plate 1005 are sufficiently positioned in sealing the junction portions because the respective color phosphors must be made to correspond to the surface conduction electron-emitting devices, as a matter of course.

The glass vessel formed in the above manner is evacuated by a vacuum pump through an exhaust pipe (not shown). After achieving a sufficient vacuum, a voltage is applied between device electrodes 1203 through external terminals DR1 to DRm and DL1 to DLm, thereby performing energization forming and activation processes. With these processes, electron-emitting portions 1205 are formed, and the surface conduction electron-emitting devices are formed on the substrate 1001. The exhaust pipe (not shown) is heated by a gas burner in a vacuum atmosphere of about $10^{-6}$ Torr to weld the exhaust pipe, thereby sealing the envelope. Finally, a getter process is performed to maintain the vacuum after sealing.

In the display panel formed in the above manner, voltages are applied to the surface conduction electron-emitting devices through the external terminals DR1 to DRm and DL1 to DLm, thereby causing the respective electron-emitting portions 1205 to emit electrons. The emitted electrons pass through the electron pass holes 205 of the grids (modulating electrodes) 206 for modulating the electron beams and are accelerated by a high voltage of several kV or more, which is applied to a metal back 1009 or a transparent electrode (not shown) through a high-voltage terminal Hv, so that the electrons are bombarded against the phosphor film 1008. With this operation, the phosphors 92 are excited to emit light. When a voltage according to an image signal is applied to the grids 206 through terminals G1 to Gn, the electron beams passing through the electron pass holes 205 are controlled to form an image.

In the second embodiment, the grids 206 each having the electron pass holes 205 with a diameter of almost 50 $\mu$m are arranged almost 10 $\mu$m above the substrate 1001 through an insulating layer (not shown) consisting of, e.g., $SiO_2$. When an accelerating voltage of 6 kV is applied, ON/OFF of an electron beam (i.e., whether the electron beam passes through the electron pass hole 205 or not) can be controlled by a modulating voltage (grid voltage Vg) of 50 V or less.

Figure 22:
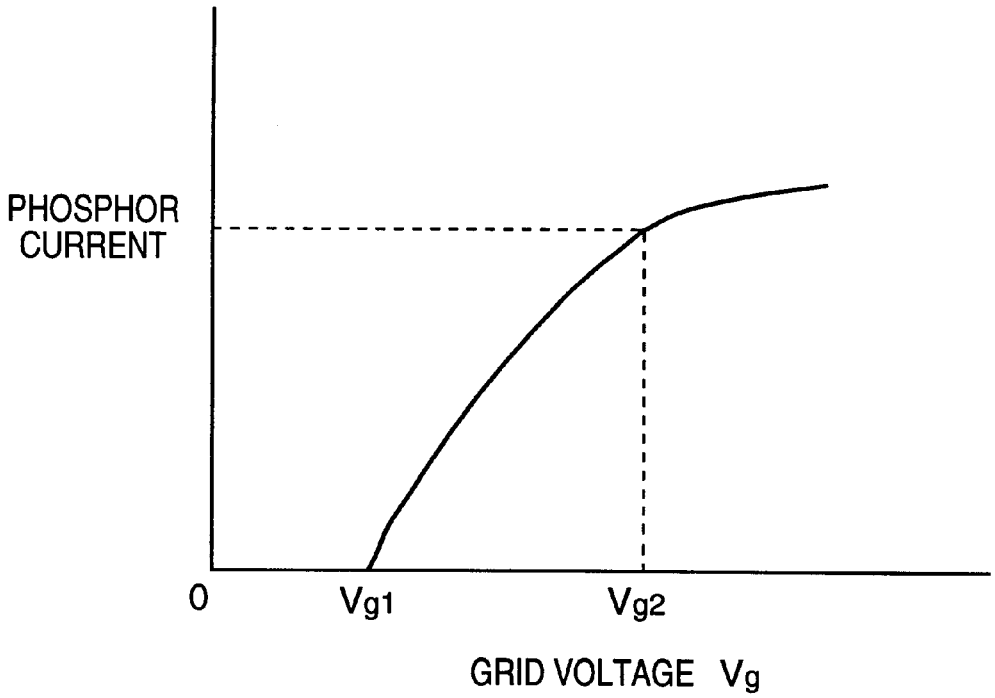
FIG. 22 is a graph showing the relationship between a grid voltage and a phosphor current in the second embodiment.

FIG. 22 is a graph showing the relationship between the grid voltage Vg applied to the grids 206 and the phosphor current flowing to the phosphor film 1008. As the grid voltage Vg is increased to a certain threshold voltage Vg1 or more, the phosphor current starts to flow. When the grid voltage Vg is further increased, the phosphor current monotonously increases and is saturated eventually at Vg2.

The above-described arrangement is necessary for manufacturing a display panel, though the details including the materials and dimensions of the respective members, and the positional relationship therebetween are not limited to those described above and can appropriately be selected in accordance with the application purpose of the image display apparatus.

The basic arrangement and manufacturing method of the display panel of the second embodiment have been described above. In the second embodiment as well, different electron-emitting characteristics are stored in units of surface conduction electron-emitting devices in accordance with the light emission colors of the phosphors. In the display panel of the second embodiment, the striped three-primary-color phosphors are applied to be parallel to the arrays of electrically connected devices. Therefore, a memory voltage pulse is applied to each array of parallel connected devices. The conditions such as a vacuum atmosphere and the like at this time are the same as those in the first embodiment.

After the electron-emitting characteristic is stored in units of device arrays, a driving circuit for TV display is connected. With this arrangement, a display operation with a satisfactory color balance can be performed. The main arrangement of the driving circuit for TV display is almost the same as that of the first embodiment shown in FIG. 13. In the second embodiment, however, an output voltage from a modulating signal generator 107 is set to a voltage suitable for modulation by the grids 206 and connected to the terminals G1 to Gn of the display panel. The output voltage from a scanning circuit 102 is set such that the scanning voltage=14.0 V and the non-scanning voltage=0 V and is connected to the terminals DL1 to DLm of the display panel. The terminals DR1 to DRm are always set at 0 V.

As described above, according to the second embodiment, a display panel having grids for modulating electron beams is used. Even in this case, when the electron-emitting characteristics of the surface conduction electron-emitting devices each having a memory function are appropriately stored in correspondence with the corresponding phosphor colors, the white balance of light emission of the R, G and B, i.e., the three primary color, phosphors can be appropriately set.

<Third Embodiment>

The third embodiment of the present invention will be described below.

In the third embodiment, a multifunction display apparatus capable of displaying image information supplied from various image information sources such as TV broadcasting on a display panel using surface conduction electron-emitting devices as electron-emitting devices, which display panel is manufactured in a manner described in the first and second embodiments, will be described.

Figure 23:
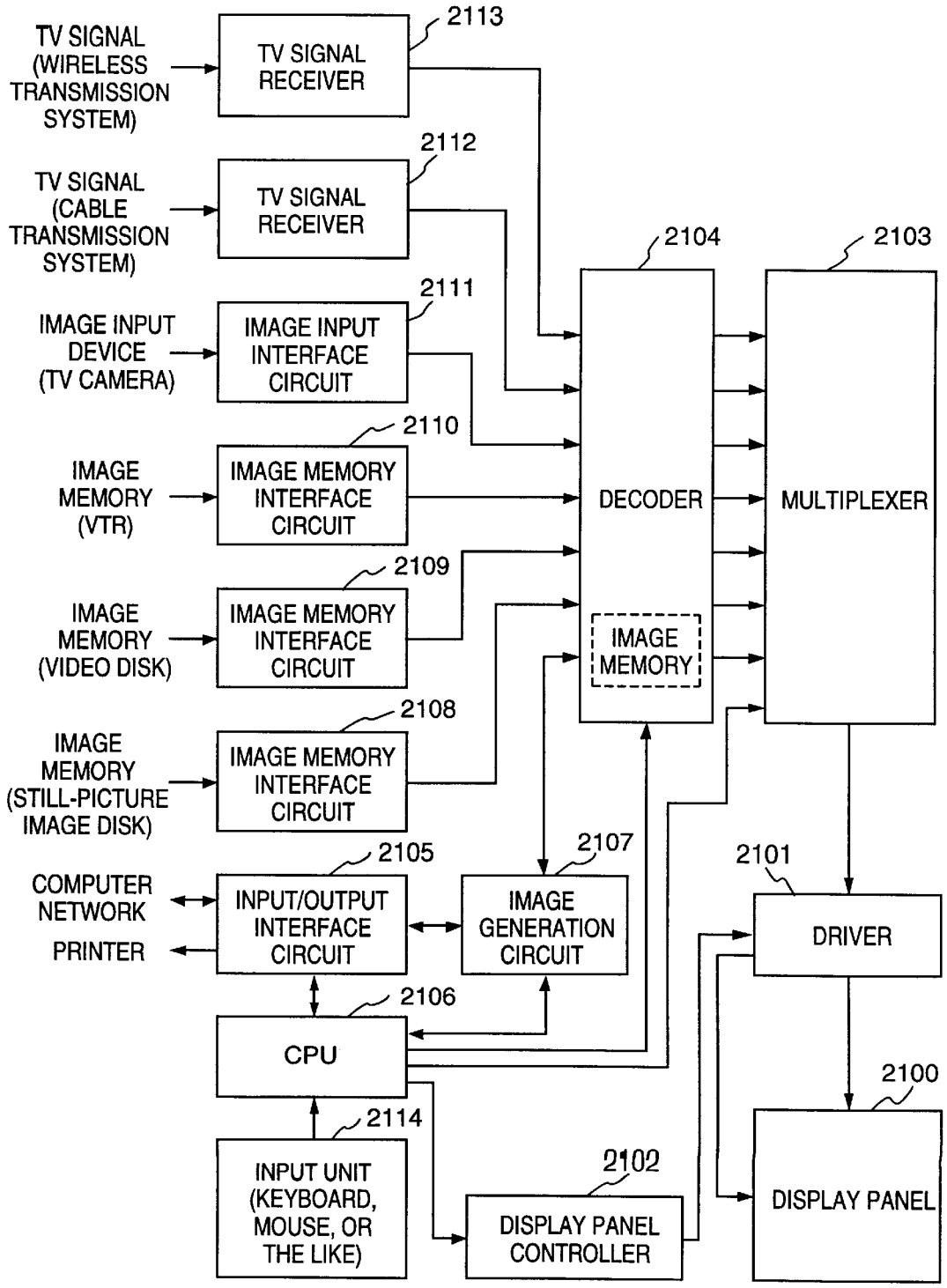
FIG. 23 is a block diagram showing the arrangement of a multifunction image display apparatus according to the third embodiment of the present invention.
Figure 24:
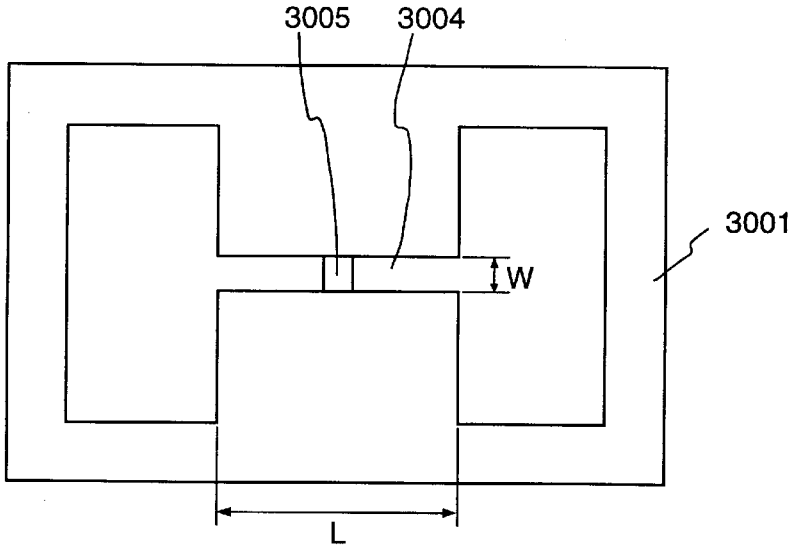
FIG. 24 is a plan view of a conventional surface conduction electron-emitting device.
Figure 25:
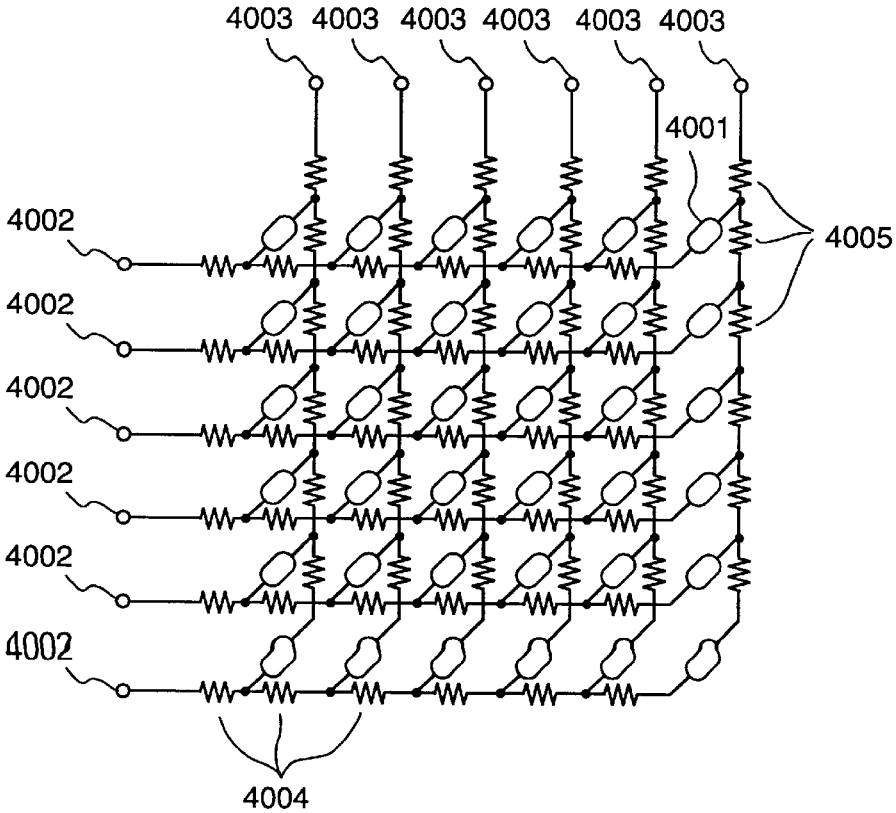
FIG. 25 is a view showing a conventional multi-electron source.

FIG. 23 is a block diagram showing an example of the multifunction display apparatus of the third embodiment. Referring to FIG. 23, reference numeral 2100 denotes a display panel using, as an electron source, surface conduction electron-emitting devices in which the electron-emitting characteristics are stored, 2101 a driver of the display panel, 2102 a display panel controller, 2103 a multiplexer, 2104 a decoder, 2105 an input/output interface circuit, 2106 a CPU, 2107 a image generator, 2108 to 2110 image memory interface circuits, 2111 an image input interface circuit, 2112 and 2113 TV signal receivers, and 2114 an input unit for receiving an input from an input device such as a keyboard or a mouse.

When the multifunction display apparatus of the third embodiment receives a signal such as a TV signal including both video information and audio information, video images and sound are reproduced simultaneously, as a matter of course. A description of circuits and speakers which are associated with reception, separation, processing, and storage of audio information will be omitted because these components are not directly related to the feature of the present invention.

The functions of the respective components will be described below in accordance with the flow of an image signal.

The TV signal receiver 2113 is a circuit for receiving TV image signals transmitted via a wireless transmission system such as electric wave transmission or space optical communication. The standards of the TV signals to be received are not particularly limited, and any one of the NTSC, PAL, and SECAM standards may be used. In addition, a TV signal comprising a larger number of scanning lines (e.g., a signal for a so-called high-definition TV represented by the MUSE standard) is a preferable signal source for utilizing the advantageous features of the display panel applicable to a large display screen and numerous pixels. The TV signal received by the TV signal receiver 2113 is output to the decoder 2104.

The TV signal receiver 2112 is a circuit for receiving TV image signals transmitted via a cable transmission system such as a coaxial cable system or an optical fiber system. Like the TV signal receiver 2113, the standards of the TV signals to be received are not particularly limited. The TV signal received by the TV signal receiver 2112 is also output to the decoder 2104.

The image input interface circuit 2111 is a circuit for receiving an image signal supplied from an image input device such as a TV camera or an image reading scanner. The received image signal is output to the decoder 2104.

The image memory interface circuit 2110 is a circuit for receiving an image signal stored in a video tape recorder (to be abbreviated as a VTR hereinafter). The received image signal is output to the decoder 2104.

The image memory interface circuit 2109 is a circuit for receiving an image signal stored in a video disk. The received image signal is output to the decoder 2104.

The image memory interface circuit 2108 is a circuit for receiving an image signal from a device such as a still-picture image disk which stores still-picture image data. The received still-picture image data is output to the decoder 2104.

The input/output interface circuit 2105 is a circuit for connecting the display apparatus to an external computer, a computer network, or an output device such as a printer. The input/output interface circuit 2105 not only inputs/outputs image data or character/graphic information, but also can input/output control signals or numerical data between the CPU 2106 of the image forming apparatus and an external device, as needed.

The image generator 2107 is a circuit for generating display image data on the basis of image data or character/graphic information externally input through the input/output interface circuit 2105 or image data or character/graphic information output from the CPU 2106. The image generator 2107 incorporates circuits necessary for generating image data, including a reloadable memory for accumulating image data or character/graphic information, a read only memory which stores image patterns corresponding to character codes, and a processor for performing image processing.

The display image data generated by the image generator 2107 is output to the decoder 2104. However, the display image data can be output to an external computer network or a printer through the input/output interface circuit 2105, as needed.

The CPU 2106 mainly performs an operation associated with operation control of the display apparatus and generation, selection and editing of a display image. For example, a control signal is output to the multiplexer 2103, thereby appropriately selecting or combining image signals to be displayed on the display panel 2100. At this time, a control signal is generated to the display controller 2102 in accordance with the image signal to be displayed, thereby appropriately controlling the operation of the display panel 2100, including the frame display frequency, the scanning method (e.g., interlaced scanning or non-interlaced scanning), and the number of scanning lines in one frame.

In addition, the CPU 2106 directly outputs image data or character/graphic information to the image generator 2107 or accesses an external computer or memory through the input/output interface circuit 2105 to input image data or character/graphic information.

The CPU 2106 may operate for other purposes. For example, the CPU 2106 may be directly associated with a function of generating or processing information, like a personal computer or a word processor. Alternatively, as described above, the CPU 2106 may be connected to an external computer network through the input/output interface circuit 2105 to cooperate with the external device in, e.g., numerical calculation.

The input unit 2114 is used by the user to input instructions, program, or data to the CPU 2106. In addition to a keyboard and a mouse, various input devices such as a joy stick, a bar-code reader, or a speech recognition device can be used.

The decoder 2104 is a circuit for reversely converting various image signals input from the image generator 2107 to the TV signal receiver 2113 into three primary color signals or a luminance signal and I and Q signals. As indicated by a dotted line in FIG. 23, the decoder 2104 preferably incorporates an image memory such that TV signals such as MUSE signals which require an image memory for reverse conversion can be processed. An image memory facilitates display of a still-picture image. In addition, the image memory enables facilitation of image processing including thinning, interpolation, enlargement, reduction and synthesizing and editing of image data in cooperation with the image generators 2107 and 2106.

The multiplexer 2103 appropriately selects a display image on the basis of a control signal input from the CPU 2106. More specifically, the multiplexer 2103 selects a desired image signal from the reverse-converted image signals input from the decoder 2104 and outputs the selected image signal to the driver 2101. In this case, the multiplexer 2103 can realize so-called multiwindow television, where the screen is divided into a plurality of areas to display a plurality of images in the respective areas, by selectively switching image signals within a display period for one frame.

The display controller 2102 is a circuit for controlling the operation of the driver 2101 on the basis of a control signal input from the CPU 2106.

For the basic operation of the display panel 2100, the display controller 2102 outputs a signal for controlling the operation sequence of the driving power supply (not shown) of the display panel 2100 to the driver 2101.

For the method of driving the display panel, the display controller 2102 outputs a signal for controlling the frame display frequency or the scanning method (e.g., interlaced scanning or non-interlaced scanning) to the driver 2101. The display controller 2102 outputs a control signal associated with adjustment of the image quality including the luminance, contrast, color tone, and sharpness of a display image to the driver 2101, as needed. The driver 2101 is a circuit for generating a driving signal to be supplied to the display panel 2100. The display panel 2100 operates on the basis of an image signal input from the multiplexer 2103 and a control signal input from the display controller 2102.

The functions of the respective components shown in FIG. 23 have been described above. The display apparatus having the arrangement shown in FIG. 23 can display, on the display panel 2100, image information input from various image information sources.

More specifically, various image signals including TV broadcasting signals are subjected to reverse conversion by the decoder 2104, appropriately selected by the multiplexer 2103, and input to the driver 2101. The display controller 2102 generates a control signal for controlling the operation of the driver 2101 in accordance with the image signal to be displayed. The driver 2101 supplies a driving signal to the display panel 2100 on the basis of the image signal and the control signal.

With this operation, an image is displayed on the display panel 2100. The series of operations are integrally controlled by the CPU 2106.

This display apparatus not only displays image data selected from a plurality of image information in association with the image memory incorporated in the decoder 2104, the image generator 2107, and the CPU 2106, but also can perform, for image information to be displayed, image processing including enlargement, reduction, rotation, movement, edge emphasis, thinning, interpolation, color conversion and aspect ratio conversion and image editing including synthesizing, deletion, combining, replacement, and insertion. Though not particularly referred to in the description of the third embodiment, circuits dedicated to processing and editing of audio information may be arranged, as for image processing and image editing.

The multifunction display apparatus can realize the functions of various devices, e.g., a TV broadcasting display device, a teleconference terminal device, an image editing device for still-pictures and moving pictures, an office-work terminal device such as a computer terminal or a word processor, a game machine, and the like. Therefore, the display apparatus has a wide application range for industrial and private use.

FIG. 23 only shows an example of the arrangement of the multifunction display apparatus using the display panel in which surface conduction electron-emitting devices are used as an electron source, and the display apparatus of the present invention is not limited to this arrangement, as a matter of course. For example, of the constituent elements shown in FIG. 23, circuits associated with functions unnecessary for the application purpose can be omitted. Reversely, constituent elements can be added in accordance with the application purpose. When this multifunction display apparatus is to be used as a visual telephone, preferably, a TV camera, a microphone, an illumination device, and a transmission/reception circuit including a modem may be added.

Since this display apparatus uses, as its electron source, surface conduction electron-emitting devices, a low-profile display panel can be realized, so that the depth of the display apparatus can be reduced. In addition, since the display panel using surface conduction electron-emitting devices as the electron source can be easily enlarged, and it has a high luminance and a wide view angle, the image forming apparatus can display vivid images with realism and impressiveness.

As described above, according to the third embodiment, the multifunction display apparatus can be constituted by the display panel using, as an electron source, surface conduction electron-emitting devices in which the electron-emitting characteristics are stored. Therefore, a display apparatus having excellent applicability, a multifunction, and excellent color reproduction (white balance) properties can be provided.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

a plurality of surface conduction electron-emitting devices arranged on a substrate;

a light emission means for emitting light upon irradiation of an electron beam from each of said plurality of surface conduction electron-emitting devices; and a modulating means for modulating the electron beam being irradiated on said light emission means on the basis of an input image signal;

wherein, for each of said surface conduction electron-emitting devices, an electron-emitting characteristic is shifted, in advance, in accordance with a light emission characteristic of said light emission means by applying a voltage larger than a maximum voltage of a driving voltage for driving the surface conduction electron-emitting device so as to form an image corresponding to the input image signal.

2. The apparatus according to claim 1, wherein said surface conduction electron-emitting devices are arranged in a vacuum vessel in which a partial pressure of an organic gas is not more than $1\times10^{-8}$ Torr.

3. The apparatus according to claim 1, wherein said light emission means comprises phosphors.

4. The apparatus according to claim 3, wherein said phosphors have three primary colors of red, green, and blue, and the electron-emitting characteristic of each of said surface conduction electron-emitting devices is shifted such that a white balance of said three primary colors is maintained.

5. The apparatus according to claim 1, wherein said plurality of surface conduction electron-emitting devices are two-dimensionally arranged and wired in a matrix by row wiring layers and column wiring layers substantially perpendicular to said row wiring layers.

6. The apparatus according to claim 2, wherein said plurality of surface conduction electron-emitting devices are two-dimensionally arranged and wired in a matrix by row wiring layers and column wiring layers substantially perpendicular to said row wiring layers.

7. The apparatus according to claim 4, wherein said plurality of surface conduction electron-emitting devices are two-dimensionally arranged and wired in a matrix by row wiring layers and column wiring layers substantially perpendicular to said row wiring layers.

8. The apparatus according to claim 1, wherein said plurality of surface conduction electron-emitting devices are arranged in a row direction, and grid electrodes are arranged in a column direction substantially perpendicular to the row direction.

9. The apparatus according to claim 2, wherein said plurality of surface conduction electron-emitting devices are arranged in a row direction, and grid electrodes are arranged in a column direction substantially perpendicular to the row direction.

10. The apparatus according to claim 4, wherein said plurality of surface conduction electron-emitting devices are arranged in a row direction, and grid electrodes are arranged in a column direction substantially perpendicular to the row direction.

11. A method of manufacturing an image forming apparatus having:

a multi-electron-beam source having a plurality of surface conduction electron-emitting devices arranged on a substrate;

a light emission means for emitting light upon irradiation of an electron beam from said multi-electron-beam source; and a driving means for applying a driving voltage to said multi-electron-beam source on the basis of an input image signal so as to form an image corresponding to the input image signal, comprising the step of:

applying a characteristic shift voltage larger than a maximum voltage of the driving voltage applied by said driving means to said surface conduction electron-emitting devices, in advance, in accordance with a light emission characteristic of said light emission means, so as to change the electron-emitting characteristics of said surface conduction electron-emitting devices.

12. The method according to claim 11, wherein the characteristic shift voltage is applied in a vacuum atmosphere in which a partial pressure of an organic gas is not more than $10^{-8}$ Torr.

13. The method according to claim 12, wherein said light emission means comprises phosphors.

14. The method according to claim 13, wherein said phosphors have three primary colors of red, green, and blue, and the electron-emitting characteristic of each of said surface conduction electron-emitting devices is shifted such that a white balance of said three primary colors is maintained.

15. The method according to claim 11, wherein, in said multi-electron-beam source, said plurality of surface conduction electron-emitting devices are wired in a matrix by a plurality of column wiring layers and a plurality of row wiring layers.

16. A method of adjusting an image forming apparatus having:

a multi-electron-beam source having a plurality of surface conduction electron-emitting devices arranged on a substrate;

a light emission means for emitting light upon irradiation of an electron beam from said multi-electron-beam source; and a driving means for applying a driving voltage to said multi-electron-beam source on the basis of an input image signal so as to form an image corresponding to the input image signal, comprising the step of:

applying a characteristic shift voltage larger than a maximum voltage of the driving voltage applied by said driving means to said surface conduction electron-emitting devices, in advance, in accordance with a light emission characteristic of said light emission means, so as to change the electron-emitting characteristics of said surface conduction electron-emitting devices.

17. The method according to claim 16, wherein the characteristic shift voltage is applied in a vacuum atmosphere in which a partial pressure of an organic gas is not more than $10^{-8}$ Torr.

18. The method according to claim 16, wherein said light emission means comprises phosphors.

19. The method according to claim 18, wherein said phosphors have three primary colors of red, green, and blue, and the electron-emitting characteristic of each of said surface conduction electron-emitting devices is shifted such that a white balance of said three primary colors is maintained.

20. The method according to claim 16, wherein, in said multi-electron-beam source, said plurality of surface conduction electron-emitting devices are wired in a matrix by a plurality of column wiring layers and a plurality of row wiring layers.

* * * * *

UNITED STATES PATENT AND TRADEMARK OFFICE

CERTIFICATE OF CORRECTION

PATENT NO. : 6,184,851 B1
DATED : February 6, 2001
INVENTOR(S) : Eiji Yamaguchi et al.

It is certified that error appears in the above-identified patent and that said Letters Patent is hereby corrected as shown below:

Sheet 14,
Fig. 15, "THERD" should read -- THIRD --.

Column 6,
Line 30, "85" should read -- multi-electron beam source --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*